US008651079B2

(12) United States Patent
Aquino

(10) Patent No.: US 8,651,079 B2
(45) Date of Patent: Feb. 18, 2014

(54) DEACTIVATING HYDRAULIC VALVE LASH ADJUSTER/COMPENSATOR WITH TEMPORARY LASH COMPENSATION DEACTIVATION

(75) Inventor: Phillip Aquino, Columbus, OH (US)

(73) Assignee: Honda Motor Co., Ltd., Tokyo (JP)

( * ) Notice: Subject to any disclaimer, the term of this patent is extended or adjusted under 35 U.S.C. 154(b) by 92 days.

(21) Appl. No.: 13/356,832

(22) Filed: Jan. 24, 2012

(65) Prior Publication Data

US 2013/0186359 A1 Jul. 25, 2013

(51) Int. Cl.
*F01L 1/14* (2006.01)

(52) U.S. Cl.
USPC ..... 123/90.55; 123/90.45; 123/90.48; 123/90.52

(58) Field of Classification Search
USPC ..... 123/90.48, 90.52, 90.55, 90.45
See application file for complete search history.

(56) References Cited

U.S. PATENT DOCUMENTS

| | | | | |
|---|---|---|---|---|
| 4,770,137 | A | 9/1988 | Okabe et al. | |
| 5,361,734 | A | 11/1994 | Shirai | |
| 6,302,070 | B1 | 10/2001 | Tsukui et al. | |
| 6,382,173 | B1 | 5/2002 | Roe | |
| 6,497,207 | B2 | 12/2002 | Spath et al. | |
| 6,513,470 | B1 | 2/2003 | Hendriksma et al. | |
| 6,571,758 | B2 | 6/2003 | Tsukui et al. | |
| 6,578,535 | B2 | 6/2003 | Spath et al. | |
| 6,659,052 | B2 | 12/2003 | Kuhl | |
| 6,668,776 | B2 | 12/2003 | Hendriksma et al. | |
| 6,748,914 | B2 | 6/2004 | Spath et al. | |
| 6,814,040 | B2 | 11/2004 | Hendriksma et al. | |
| 6,938,873 | B2 | 9/2005 | Fischer | |
| 7,104,232 | B2 | 9/2006 | Hendriksma et al. | |
| 7,263,956 | B2 | 9/2007 | Spath et al. | |
| 7,296,548 | B2 | 11/2007 | Hendriksma et al. | |
| 7,299,778 | B2 | 11/2007 | Kuckuk | |
| 7,308,879 | B2 | 12/2007 | Hendriksma et al. | |
| 7,370,617 | B2 | 5/2008 | Maehara et al. | |
| 7,395,792 | B2 | 7/2008 | Hendriksma et al. | |
| 7,509,933 | B2 | 3/2009 | Dingle | |
| 7,673,601 | B2 | 3/2010 | Spath et al. | |
| 7,681,543 | B2 * | 3/2010 | Shin et al. | 123/90.48 |
| 7,757,648 | B2 | 7/2010 | Hendriksma et al. | |
| 8,051,815 | B2 | 11/2011 | Maehara et al. | |
| 2009/0199805 | A1 | 8/2009 | Hendriksma | |
| 2011/0048352 | A1 | 3/2011 | Hendriksma | |

OTHER PUBLICATIONS

International Search Report and Written Opinion of PCT/US2013/021517 dated Mar. 29, 2013.

* cited by examiner

*Primary Examiner* — Ching Chang
(74) *Attorney, Agent, or Firm* — Rankin, Hill & Clark LLP

(57) ABSTRACT

A valve operating mechanism includes a pin housing housed in a lash adjuster and a lash adjustment chamber. A sync pin is slidably received within the housing between an activating position and a deactivating position. A ball valve assembly is provided within the housing for communication with the chamber, and is moveable between an open position and a closed position. The valve operating mechanism is operable in an active mode and a deactive mode. In the active mode, the sync pin is in the activating position, a valve is in an active state and the valve operating mechanism is configured to adjust valve lash. In the deactive mode, the sync pin is in the deactivating position and the valve is in a deactive state. The valve operating mechanism is configured to generate valve lash to allow the operating mechanism to move between the active mode and the deactive mode.

22 Claims, 29 Drawing Sheets

FIG. 19
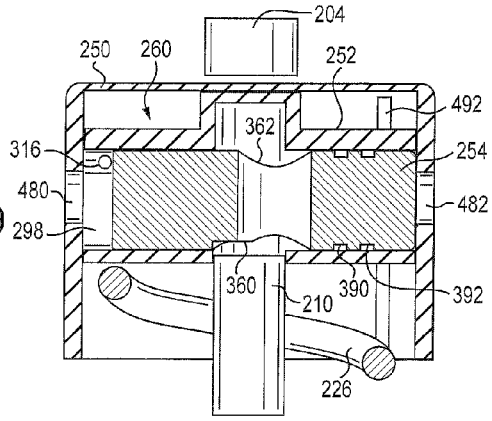
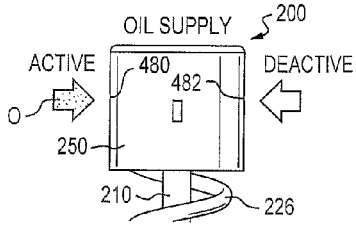
FIG. 21
FIG. 20
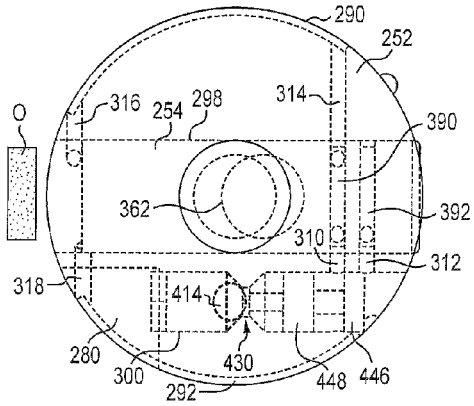
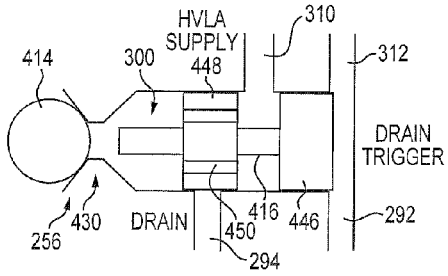
FIG. 22

FIG. 23
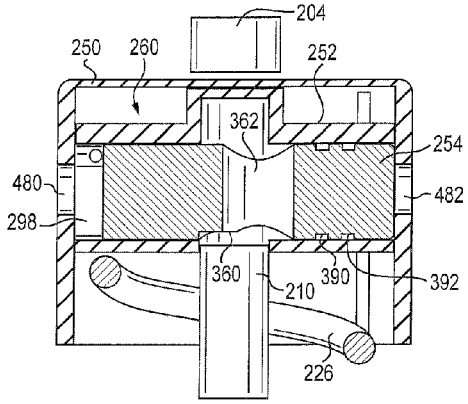
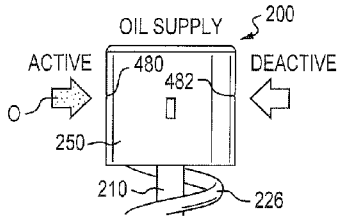
FIG. 25
FIG. 24
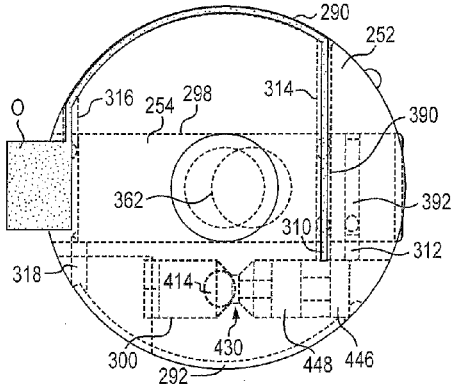
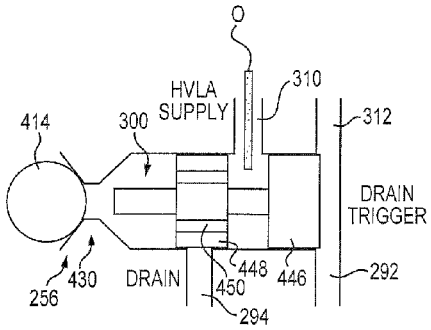
FIG. 26

FIG. 27
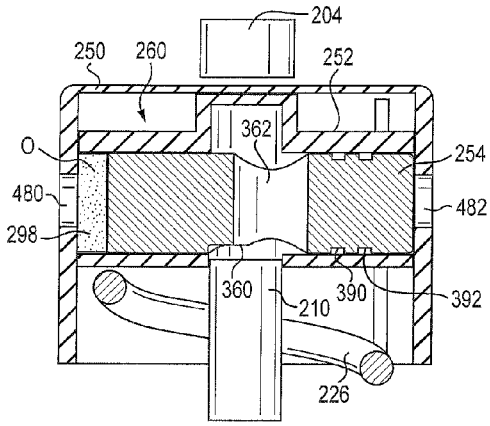
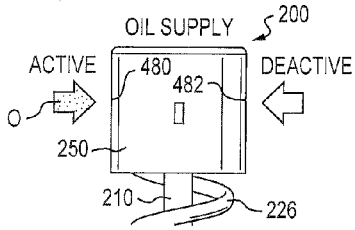
FIG. 29
FIG. 28
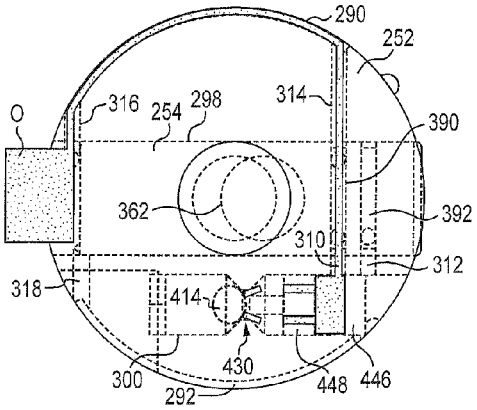
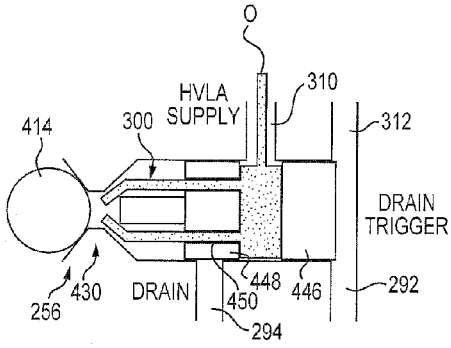
FIG. 30

FIG. 39
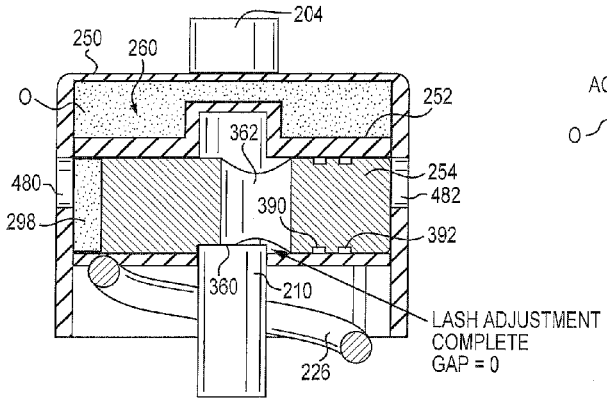
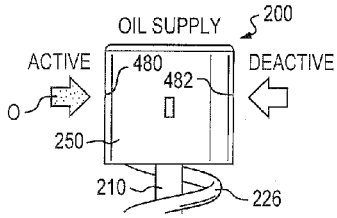
FIG. 41
FIG. 40
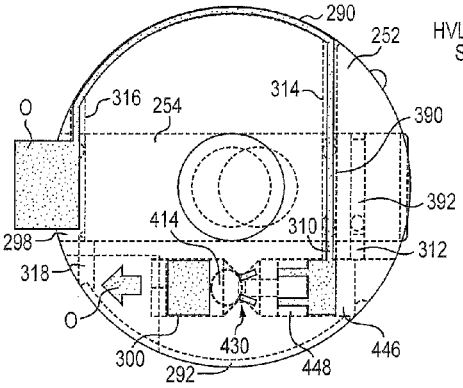
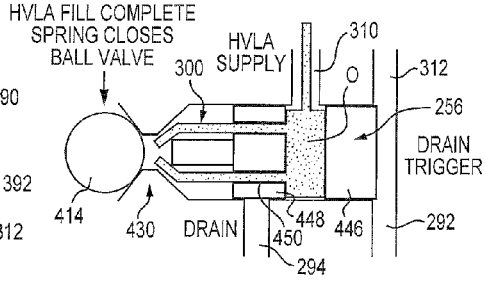
FIG. 42

FIG. 43
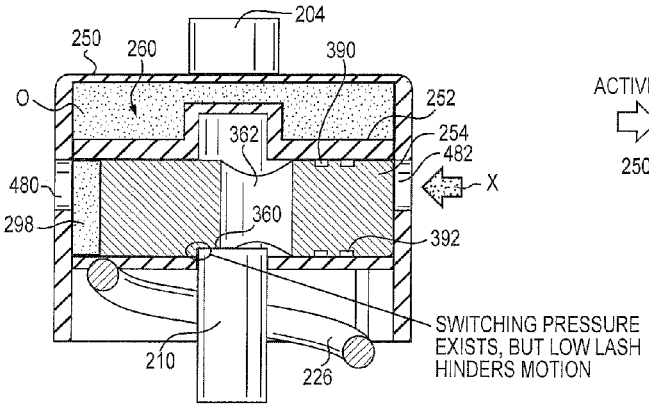
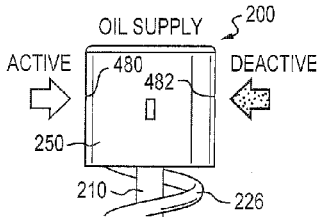
FIG. 45
FIG. 44
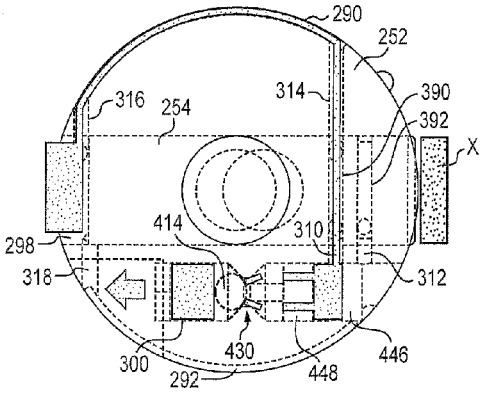
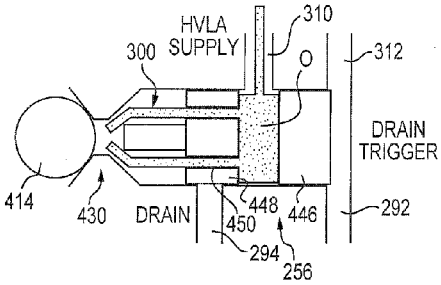
FIG. 46

FIG. 47
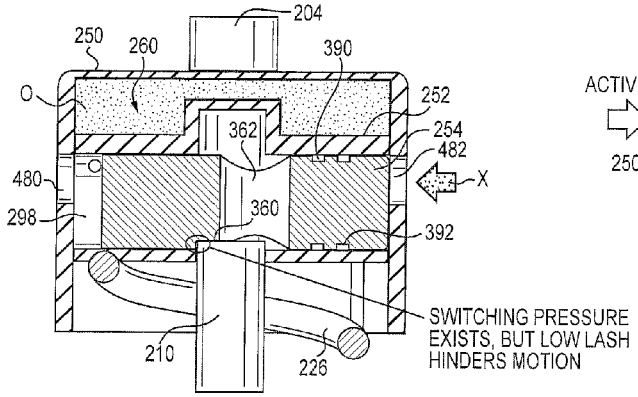
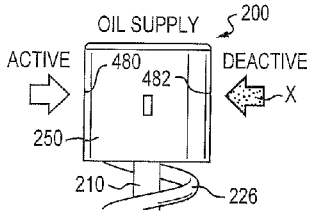
FIG. 49
FIG. 48
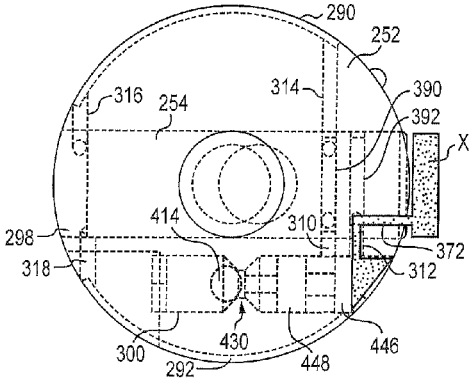
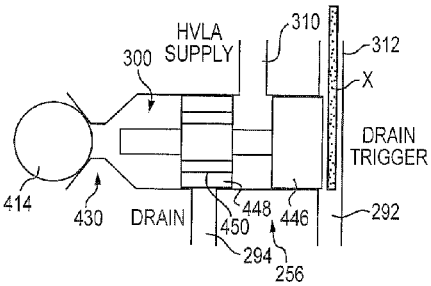
FIG. 50

DEACTIVATING HYDRAULIC VALVE LASH ADJUSTER/COMPENSATOR WITH TEMPORARY LASH COMPENSATION DEACTIVATION

BACKGROUND

Exemplary embodiments herein generally relate to a valve operating mechanism for an internal combustion engine, and, more particularly, to a deactivating hydraulic valve lash adjuster/compensator with temporary lash compensation/deactivation for improved switching response.

As is well known, valve lash is the mechanical clearance in a valve train between a camshaft and a valve in an internal combustion engine. Valve lash is usually about 0.2 mm to 0.3 mm depending on the engine specifications. Valve lash is intended to provide the greatest amount of valve opening on the high point of a camshaft lobe and assure that the valve is tightly closed on the low segment of the camshaft lobe. Hydraulic valve lash adjusters (HVLA's) or hydraulic valve lifters are widely used to eliminate service required to compensate for valve wear. The HVLA's use engine oil pressure to establish a continuous zero valve lash dimension under all conditions in the vehicle engine. While the valve is closed, the internal piston of the hydraulic lifter is lightly thrust against the pushrod by engine oil pressure to eliminate all valve train clearance. When the camshaft high spot comes around, the hydraulic lifter's fill hole is covered and the lifter acts like a solid piece of metal, and the valve opens. Thus, the HVLA ensures that the valve train always operates with zero clearance, leading to quieter operation and eliminating the need for periodic adjustment of valve clearance.

To improve fuel economy, cylinder deactivation is also widely used. Cylinder deactivation is the deactivation of the intake and/or exhaust valves of a cylinder or cylinders during at least a portion of the combustion process. In effect, cylinder deactivation reduces the number of engine cylinders within which the combustion process is taking place. With fewer cylinders performing combustion, fuel efficiency is increased and the amount of pollutants emitted from the engine will be reduced. For example, when such a system is installed in a six-cylinder engine during cylinder deactivation the valves are shut off and fuel supply in two cylinders or three cylinders is halted depending on the driving conditions. Deactivating the cylinders means that, when cylinder deactivation is in operation, it's the same as driving a car with a smaller, lower-displacement engine, emitting less $CO_2$. Cylinder deactivation deactivates the cylinder(s) by keeping the intake and exhaust valves in the closed position to halt fuel supply. To deactivate the cylinder, one example includes a pin that is moved hydraulically to disengage the rocker arm that pushes down the valve. In this mode, even though the cam pushes up on the rocker arm, it has no effect and the valve remain closed. Cylinder deactivation is effective, for example, during part-load conditions when full engine power is not required for smooth and efficient engine operation.

When valves with HVLA's are deactivated, the adjuster can eliminate the lash that is required to re-engage the valve mechanism. This is sometimes described as "pump up". When this occurs, once the valve drive mechanism is reactivated, the valve lash is too small, so that even when the cam is on the base circle and the valve should be closed, the valve can remain open. When a valve is open that should be closed, combustion gasses leak, power drops, and the valve could quickly overheat and fail, destroying the engine. Pump up can be mitigated by choking the oil supply to the HVLA. However, this also reduces the overall switching response by removing a portion of the working energy.

BRIEF DESCRIPTION

In accordance with one aspect, a valve operating mechanism for an internal combustion engine is provided. The internal combustion engine includes a valve operating cam for engaging a valve stem of a valve slidably supported in a valve body. The valve is biased by a spring in a direction to abut the operating cam and has an active state and a deactive state. The valve operating mechanism comprises a lash adjuster, a pin housing, a sync pin and a ball valve assembly. The lash adjuster is supported by the valve body. The pin housing is housed in the lash adjuster and together with the lash adjuster defines a lash adjustment chamber. The pin housing includes a supply passageway, a drain trigger passageway and a drain for the flow of pressurized oil. The sync pin is slidably received within the pin housing between an activating position and a deactivating position. The sync pin has a pin body including a valve stem contact surface for selectively engaging the valve stem and a valve stem through hole adjacent the contact surface for selectively facing the valve stem. The sync pin body further includes a first fluid path and a second fluid path for the flow of pressurized oil. The ball valve assembly is provided within the pin housing. The ball valve assembly is moveable between an open position where the ball valve assembly is in fluid communication with the lash adjustment chamber and a closed position. The valve operating mechanism is operable in one of an active mode and a deactive mode. In the active mode, the sync pin is in the activating position, the valve is in the active state and the valve operating mechanism is configured to adjust valve lash. In the deactive mode, the sync pin is in the deactivating position and the valve is in the deactive state. The valve operating mechanism is configured to generate valve lash to allow the valve operating mechanism to move between the active mode and the deactive mode.

In accordance with another aspect, a valve operating mechanism for an internal combustion engine is provided. The internal combustion engine includes a valve operating cam for engaging a valve stem of a valve slidably supported in a valve body. The valve is biased by a spring in a direction to abut the operating cam and has an active state and a deactive state. The valve operating mechanism comprises a lash adjuster, a pin housing, a sync pin and a ball valve assembly. The lash adjuster is supported by the valve body. The pin housing is housed in the lash adjuster and together with the lash adjuster defines a lash adjustment chamber. The pin housing includes a supply passageway, a drain trigger passageway and a drain for the flow of pressurized oil. The supply passageway and drain are in fluid communication with the lash adjustment chamber. The pin housing further includes a first bore and a second bore extending therethrough. The sync pin is slidably received within the first bore of the pin housing between an activating position and a deactivating position. The sync pin includes a valve stem contact surface for selectively engaging the valve stem and a valve stem through hole adjacent the contact surface for selectively facing the valve stem. The sync pin further includes a first fluid path and a second fluid path for the flow of pressurized oil.

In the activating position, the first groove is in selective communication with the supply passageway, and in the deactivating position, the second groove is in selective communication with the supply passageway. The ball valve assembly is provided within the second bore of the pin housing. The ball valve assembly is moveable between an open position where the ball valve assembly is in fluid communication with the lash adjustment chamber and a closed position. The valve operating mechanism is operable in one of an active mode and a deactive mode. In the active mode, the valve is in the active state, and in the deactive mode the valve is in the deactive state. In the active mode, oil pressure acts in a first direction on the sync pin causing the sync pin to be in the activating position. Pressurized oil flows through the supply passageway of the pin housing into the lash adjustment chamber. An increase in oil pressure in the lash adjustment chamber moves the contact surface of the pin body into engagement with the valve stem thereby adjusting the valve lash. In the deactive mode, oil pressure acts in an opposite second direction on the sync pin in the activating position causing the sync pin to move to the deactivating position. In the deactivating position, the through hole provided on the sync pin is aligned with the valve stem. Prior to moving between the active mode and the deactive mode, the valve operating mechanism is configured to generate valve lash to allow the sync pin to move between the activating position and the deactivating position.

In accordance with yet another aspect, a valve operating mechanism for an internal combustion engine comprises a valve for selectively opening and closing a port associated with a cylinder of the engine. The valve is operable in one of an active and a deactive state. A spring biases the valve toward a closed position. A valve operating cam engages a valve stem of the valve to selectively move the valve toward an open position against the biasing of the spring. A valve lash adjuster has a sync pin for adjusting a valve lash of the valve. The sync pin is moved to an activating position when the valve is in the active state wherein the sync pin inhibits lifting of the valve stem of the valve to adjust the valve lash of the valve. The sync pin is moved to a deactivating position when the valve in is in the deactive state wherein the sync pin allows complete lifting of the valve stem. Prior to moving between the active state and the deactive state, the valve operating mechanism is configured to generate valve lash to allow the sync pin to move between the activating position and the deactivating position.

In accordance with still yet another aspect, a method of operating a valve of an internal combustion engine is provided. The method comprises adjusting valve lash of the valve in a valve active state, the adjusting step including applying oil pressure in a first direction on a sync pin of a valve operating mechanism to move the sync pin to an activating position, and increasing oil pressure in a valve lash adjustment chamber defined by the valve operating mechanism to move a contact surface of the sync pin into engagement with a valve stem of the valve; moving the valve to a valve deactive state after valve lash adjustment, the moving step including applying oil pressure in an opposite second direction on the sync pin in the activating position to move the sync pin to a deactivating position, and aligning a through hole provided on the sync pin with the valve stem by increasing oil pressure in the valve lash adjustment chamber; and prior to moving the valve between the active state and the deactive state, generating valve lash by decreasing oil pressure in the lash adjustment chamber to allow the sync pin to move from the activating position to the deactivating position.

BRIEF DESCRIPTION OF THE DRAWINGS

FIGS. 19-22 illustrate the valve operating mechanism of FIG. 18 in an active mode for adjusting valve lash (internal combustion engine off/just after startup condition). FIG. 19 is a cross-sectional view of the valve operating mechanism of FIG. 1 with the sync pin in an activating position. FIG. 20 is a top plan view of the valve operating mechanism of FIG. 19 showing a flow of pressurized oil flowing in a first direction into the valve operating mechanism. FIG. 21 is a front view of the valve operating mechanism of FIG. 19 depicting the direction of the flow of pressurized oil through the valve operating mechanism. FIG. 22 is an enlarged schematic view of the ball valve assembly in a closed position.

FIGS. 23-26 are similar to FIGS. 19-22 and depict pressurized oil flowing through a supply passageway of the pin housing and into the ball valve assembly of the valve operating mechanism (start-up priming, activating oil to pin).

FIGS. 27-30 are similar to FIGS. 23-26 and illustrate pressurized oil flowing through the ball valve assembly of the valve operating mechanism (priming, activating oil to lash adjustment chamber).

FIGS. 39-42 are similar to FIGS. 35-38 and show the flow of pressurized oil in the first direction decreasing which moves the ball valve assembly back to the closed position, the valve stem engages the sync pin of the valve operating mechanism and lash adjustment of the valve is complete (stabilized).

FIGS. 43-46 are similar to FIGS. 39-42 and depict pressurized oil flowing in a second direction toward the valve operating mechanism to move the valve operating mechanism from the active mode to a deactive mode for deactivating the valve of the engine (deactivate signal begins—zero lash).

FIGS. 47-50 are similar to FIGS. 43-46 and illustrate pressurized oil flowing into a drain trigger passageway of the pin housing toward the ball valve assembly (deactivation—drain trigger).

DETAILED DESCRIPTION

It should, of course, be understood that the description and drawings herein are merely illustrative and that various modifications and changes can be made in the structures disclosed without departing from the present disclosure. In general, the figures of the exemplary hydraulic valve lash adjuster/compensator are not to scale. It should be appreciated that the term "plurality" means "two or more", unless expressly specified otherwise. It will also be appreciated that the various identified components of the exemplary hydraulic valve lash adjuster/compensator disclosed herein are merely terms of art that may vary from one manufacturer to another and should not be deemed to limit the present disclosure.

Figure 1:
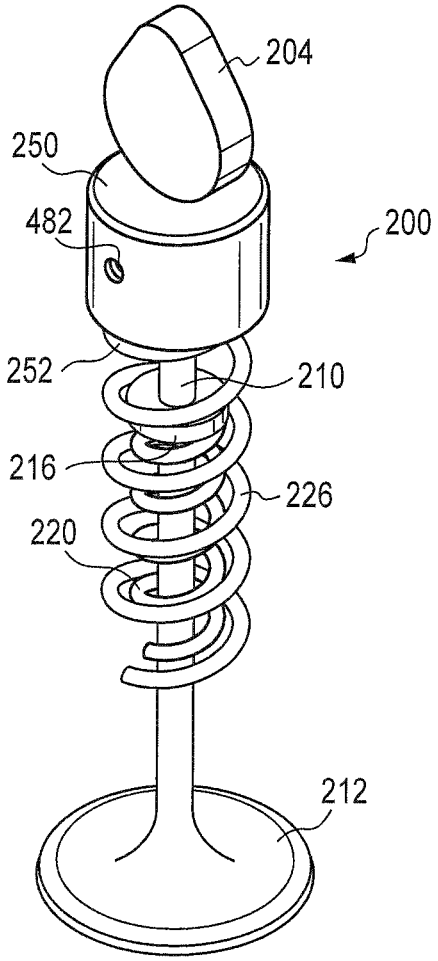
FIG. 1 is a perspective view of a valve operating mechanism for an internal combustion engine.
Figure 2:
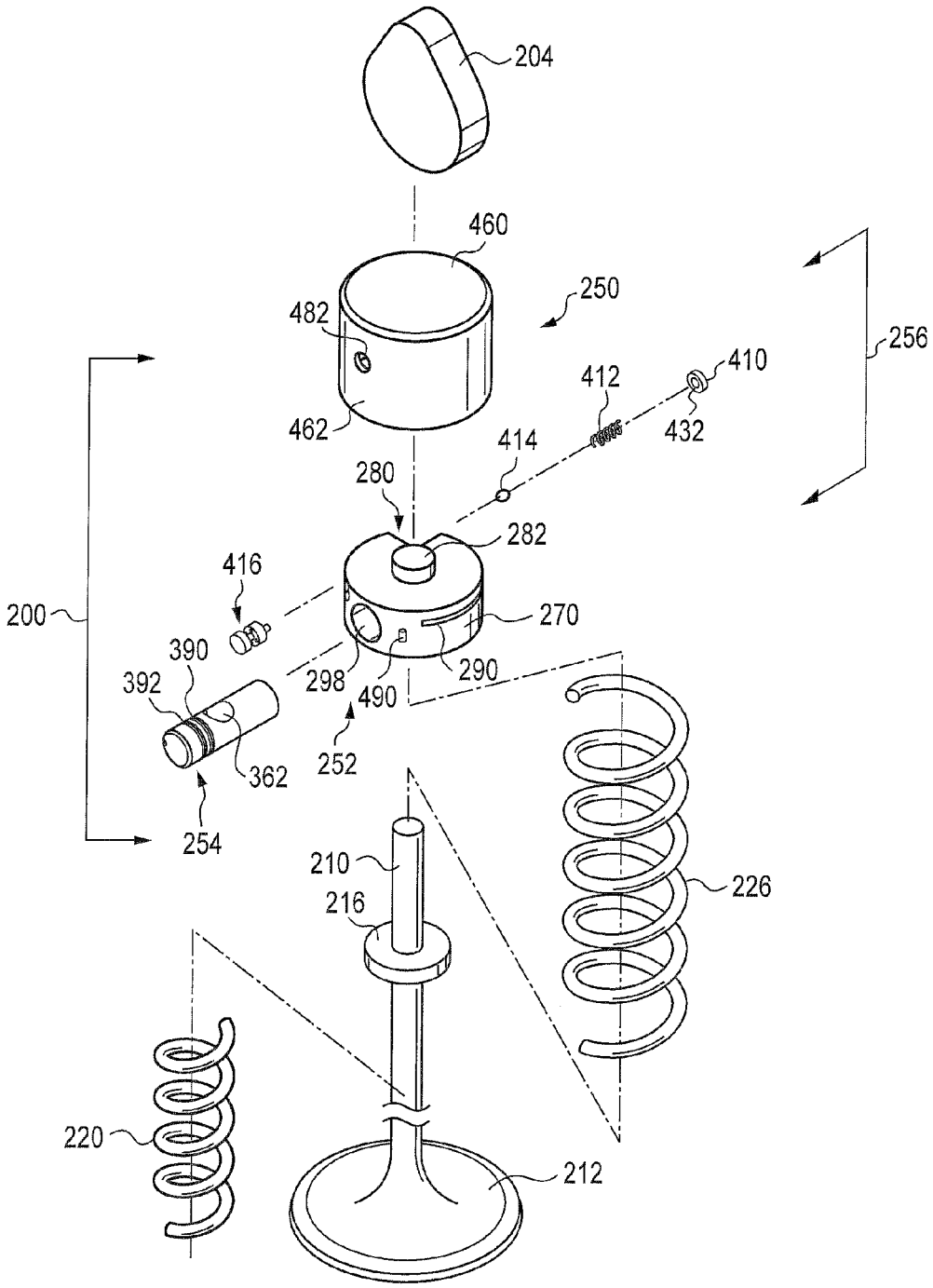
FIG. 2 is an exploded perspective view of the valve operating mechanism of FIG. 1.
Figure 18:
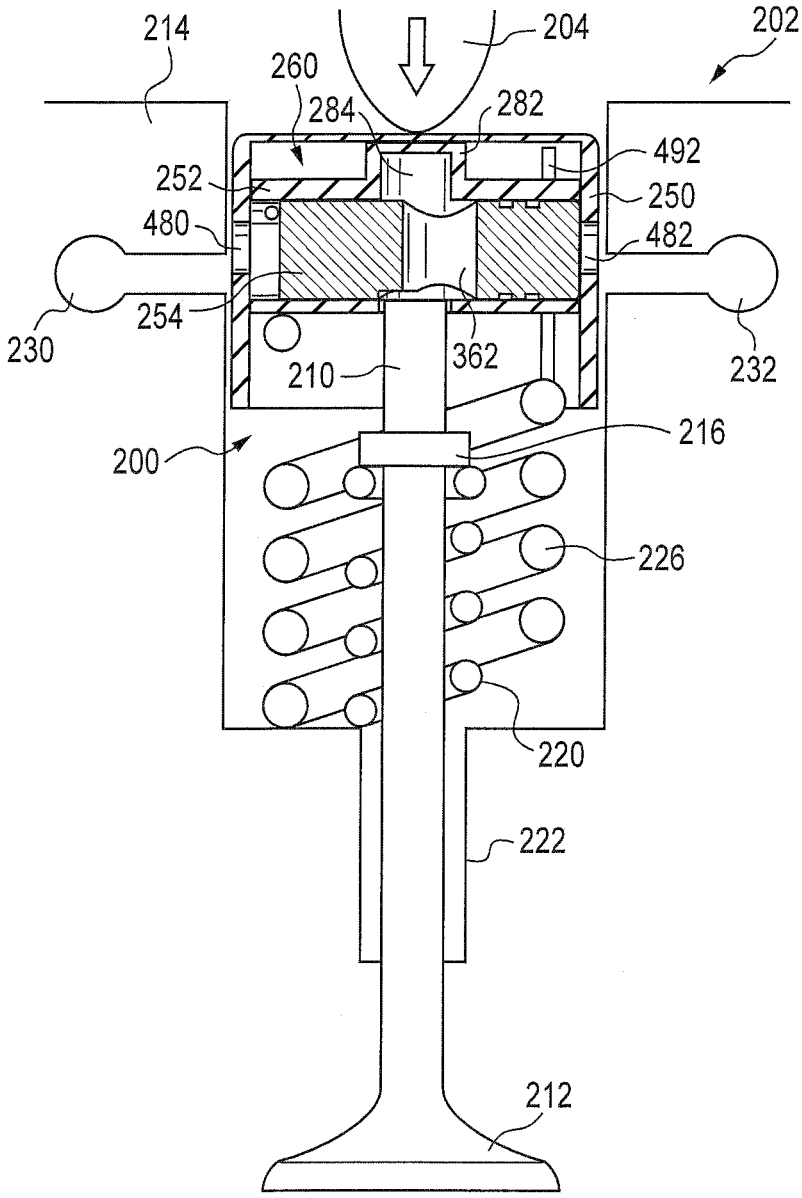
FIG. 18 is a cross-sectional view of the valve operating mechanism of FIG. 1 in a valve body of the engine, the valve operating mechanism being in an active mode.
Figure 31:
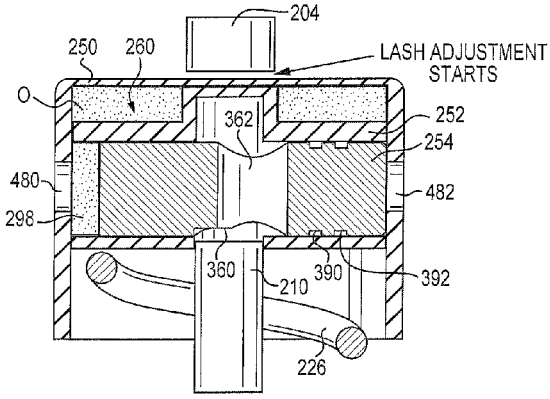
FIGS. 31-34 are similar to FIGS. 27-30 and show pressurized oil flowing through the pin housing and the ball valve assembly, the ball valve assembly being in an open position and pressurized oil flowing in the first direction flowing into a lash adjustment chamber of the valve operating mechanism (activating oil, pump up begins in lash adjustment chamber).
Figure 33:
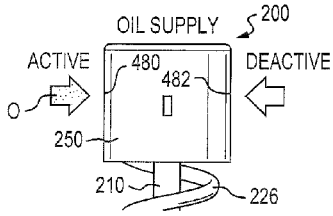
Figure 32:
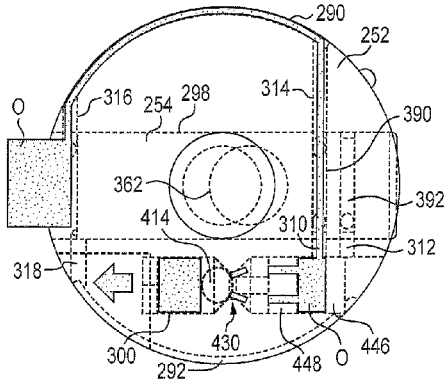
Figure 34:
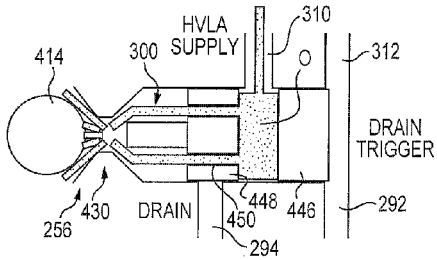
Figure 35:
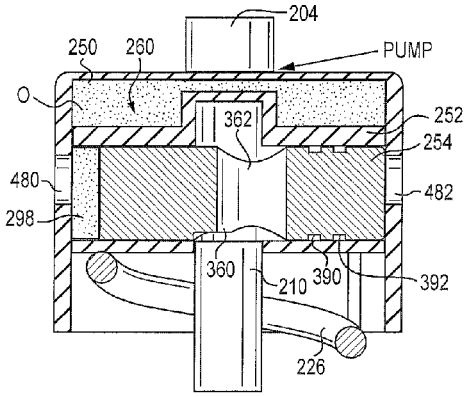
FIGS. 35-38 are similar to FIGS. 31-34 and illustrate pressurized oil flowing into the lash adjustment chamber, as oil pressure in the lash adjustment chamber continues to increase the pin housing is displaced downwardly in the lash adjuster toward a valve stem of a valve (activation pump up).
Figure 37:
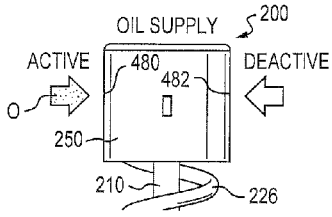
Figure 36:
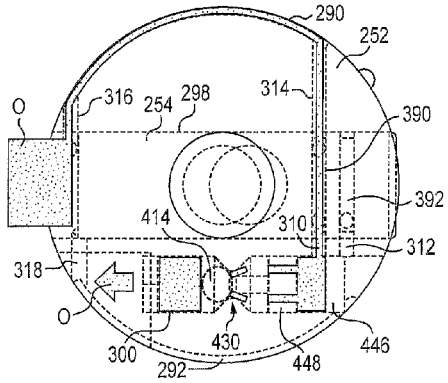
Figure 38:
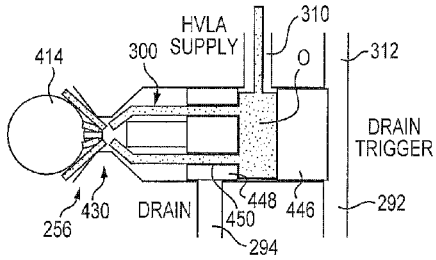
Figure 51:
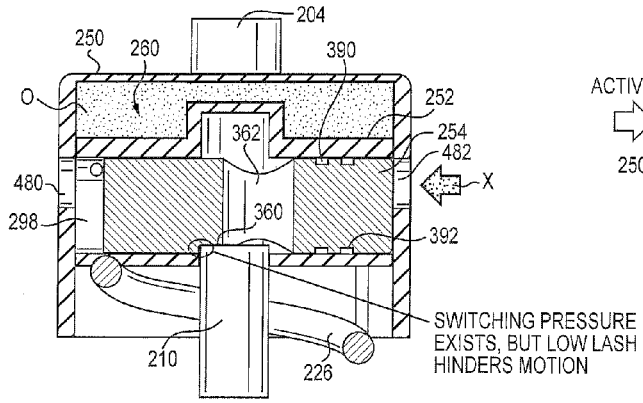
FIGS. 51-54 are similar to FIGS. 47-50 and illustrate pressurized oil flowing in the second direction moving the ball valve assembly to the open position allowing pressurized oil in the lash adjustment chamber to flow toward the ball valve assembly (deactivation—delash pin drain).
Figure 53:
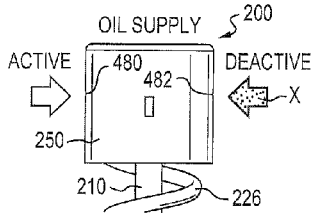
Figure 52:
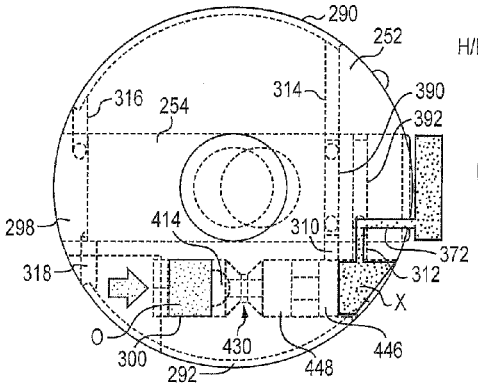
Figure 54:
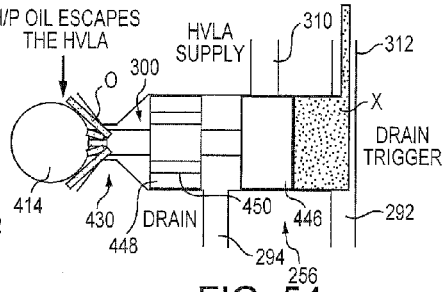
Figure 55:
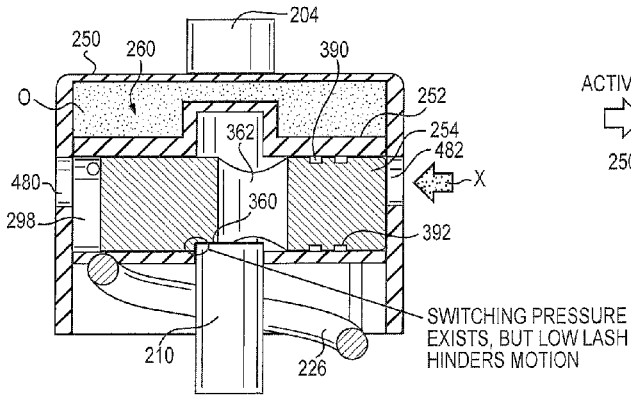
FIGS. 55-58 are similar to FIGS. 51-54 and show pressurized oil flowing from the lash adjustment chamber through the ball valve assembly in the open position and out of a drain of the pin housing (deactivation—draining).
Figure 57:
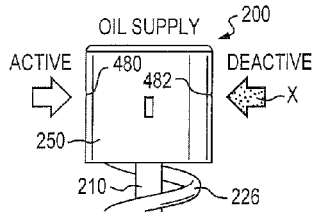
Figure 56:
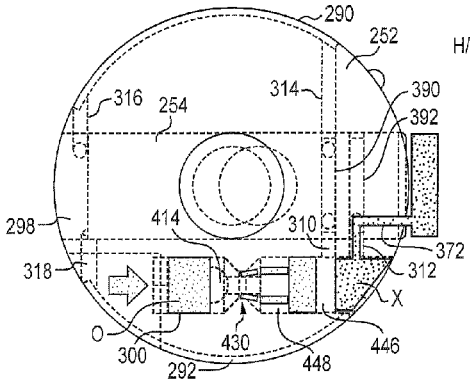
Figure 58:
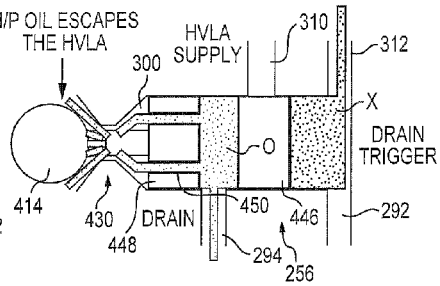
Figure 59:
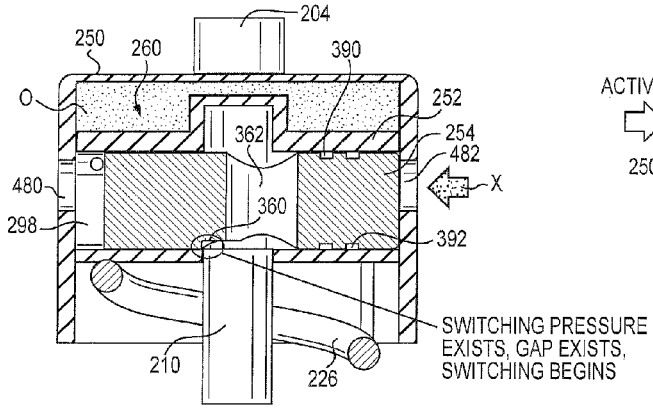
FIGS. 59-62 are similar to FIGS. 55-58 and show pressurized oil flowing from the lash adjustment chamber through the ball valve assembly in the open position and out of the drain of the pin housing, as oil pressure in the lash adjustment chamber decrease the pin housing moves upwardly in the lash adjuster thereby creating valve lash (switching begins).
Figure 61:
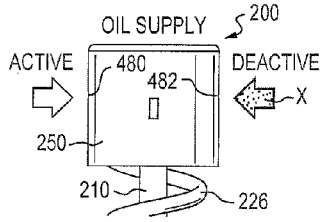
Figure 60:
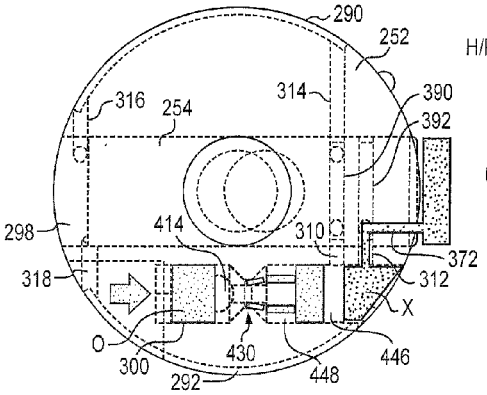
Figure 62:
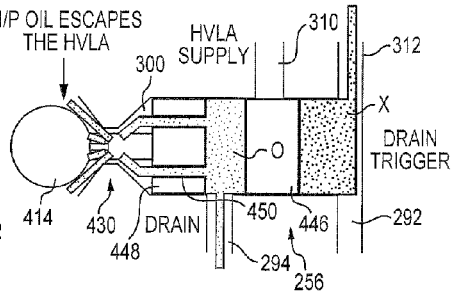
Figure 63:
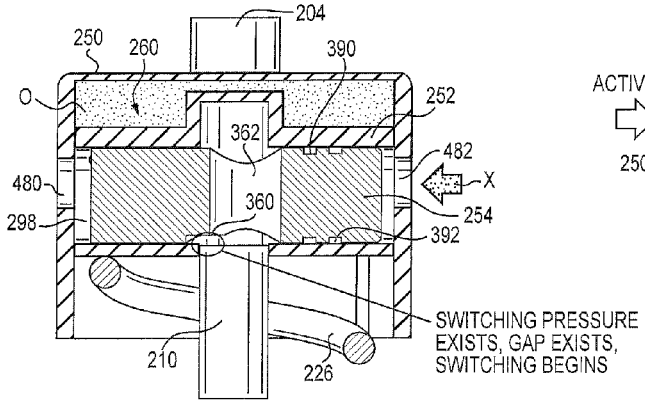
FIGS. 63-66 are similar to FIGS. 59-62 and depict the ball valve assembly in the closed position and the sync pin of the valve operating mechanism moving from the activating position toward a deactivating position (switching).
Figure 65:
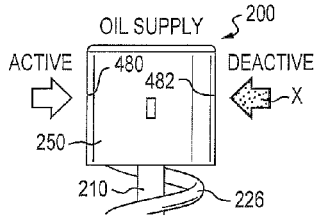
Figure 64:
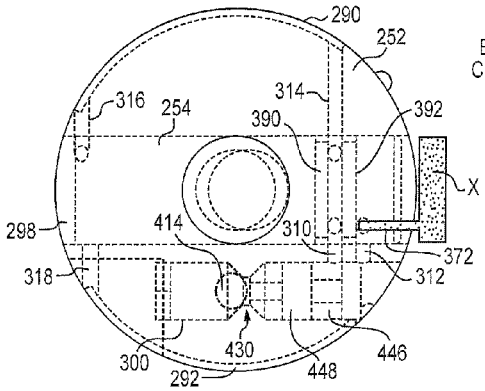
Figure 66:
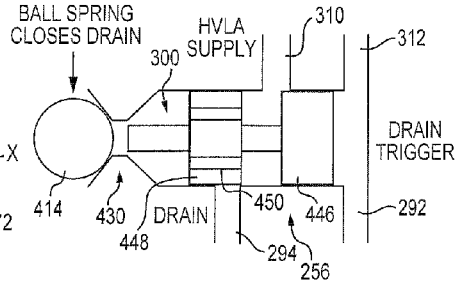
Figure 67:
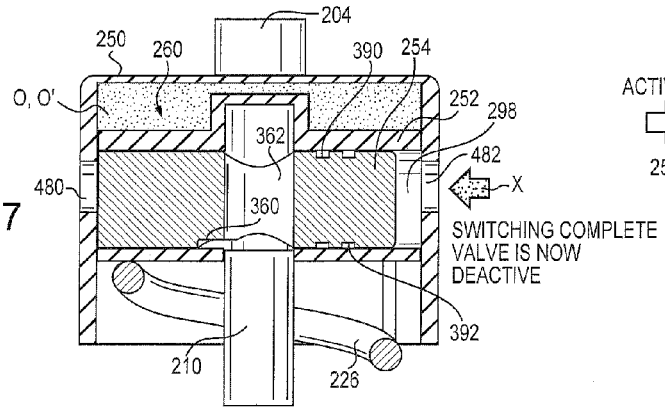
FIGS. 67-70 are similar to FIGS. 63-66 and illustrate the sync pin in the deactivating position, pressurized oil flowing in the second direction flowing into the supply passageway of the pin housing and through the ball valve assembly moving the ball valve assembly to the open position.
Figure 69:
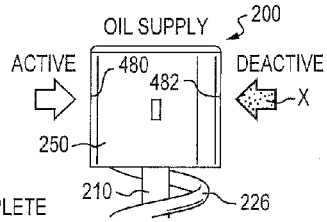
Figure 68:
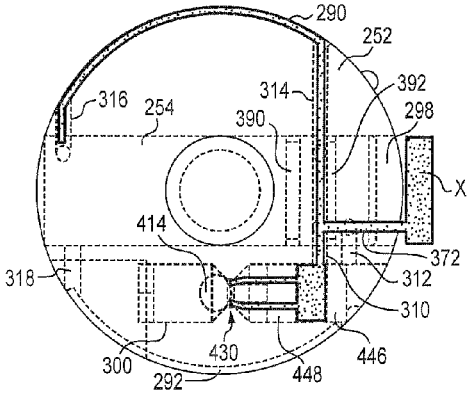
Figure 70:
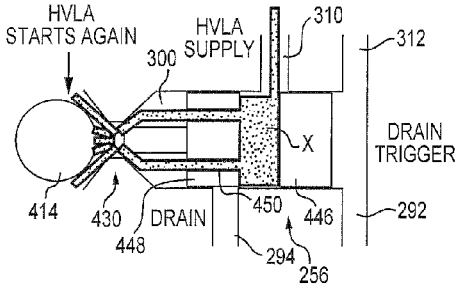
Figure 71:
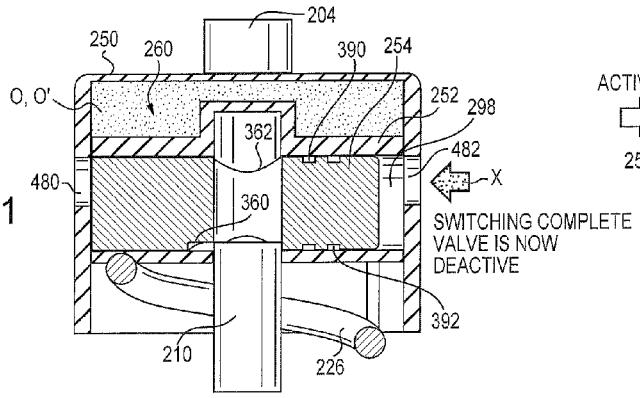
FIGS. 71-74 are similar to FIGS. 67-70 and show pressurized oil flowing in the second direction flowing through the ball valve assembly and into the lash adjustment chamber, oil pressure in the lash adjustment chamber increasing moving the pin housing downwardly in the lash adjuster, the sync pin engaging the valve stem thereby deactivating the valve (deactivation switch complete—HVLA pump begins).
Figure 73:
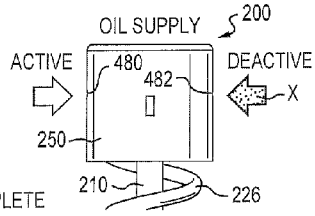
Figure 72:
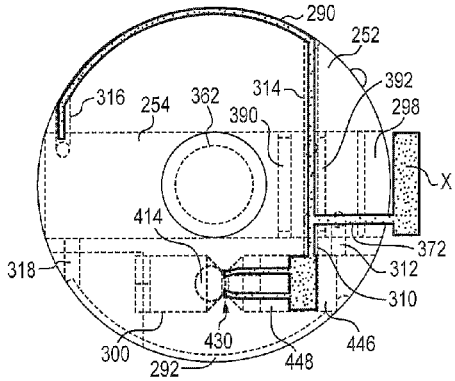
Figure 74:
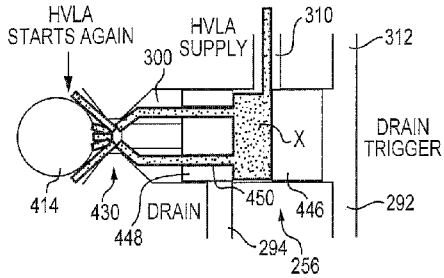
Figure 75:
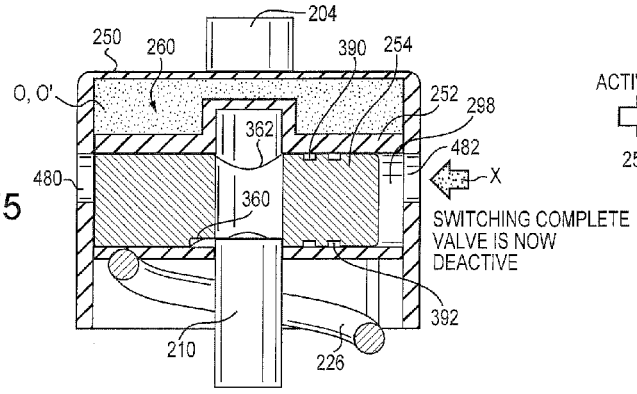
FIGS. 75-78 are similar to FIGS. 71-74 and show the flow of pressurized oil in the second direction decreasing and the ball valve assembly in the closed position (lash adjustment complete).
Figure 77:
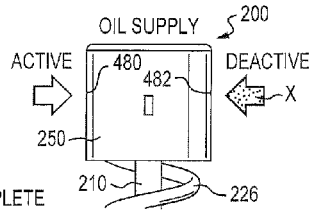
Figure 76:
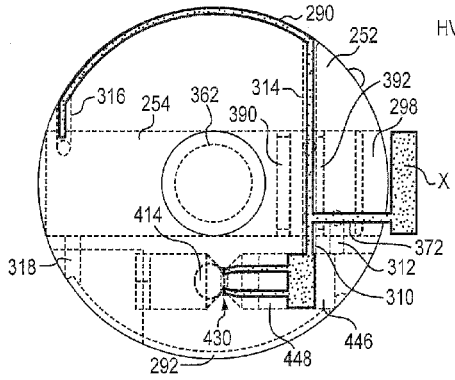
Figure 78:
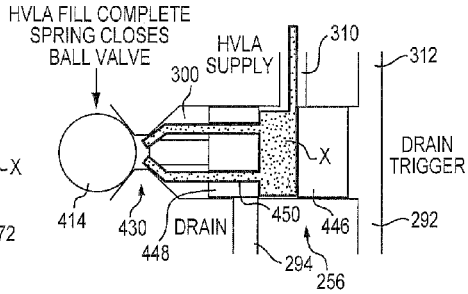
Figure 79:
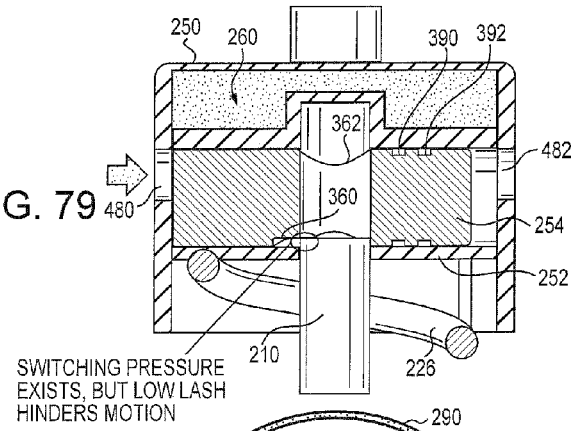
FIGS. 79-82 are similar to FIGS. 75-78 and illustrate pressurized oil flowing in the first direction toward the valve operating mechanism to move the valve operating mechanism from the deactive mode back to the active mode (deactive to active signal).
Figure 81:
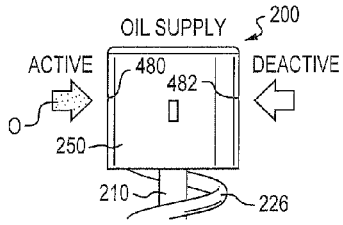
Figure 80:
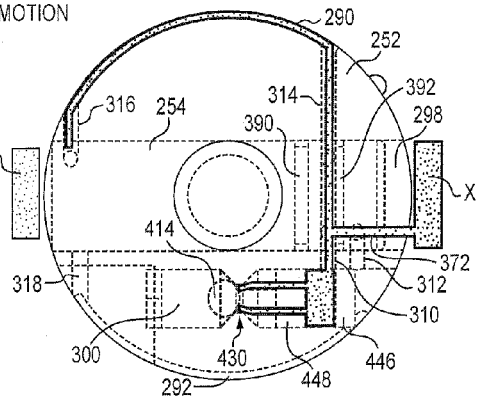
Figure 82:
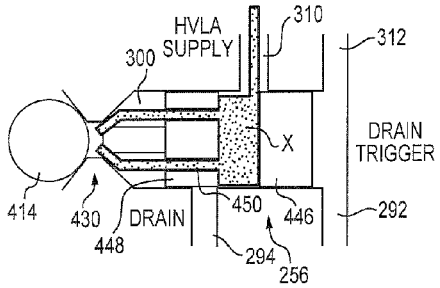
Figure 83:
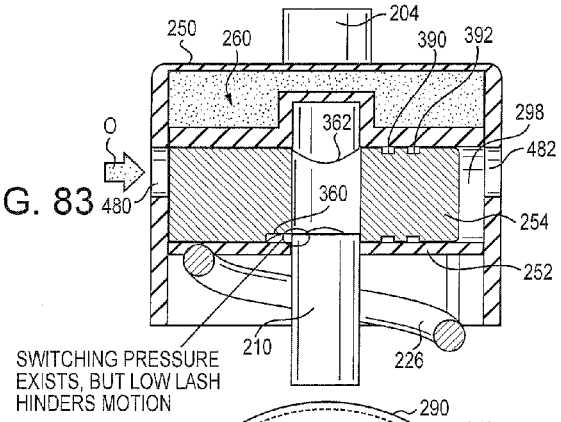
FIGS. 83-86 are similar to FIGS. 79-82 and depict pressurized oil flowing in the first direction through the drain trigger passageway of the pin housing toward the ball valve assembly (deactive to active drain trigger).
Figure 85:
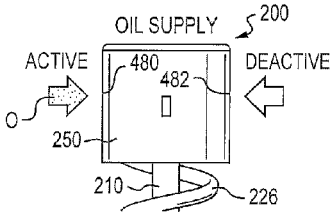
Figure 84:
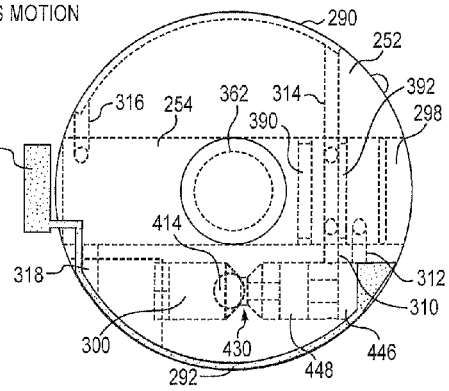
Figure 86:
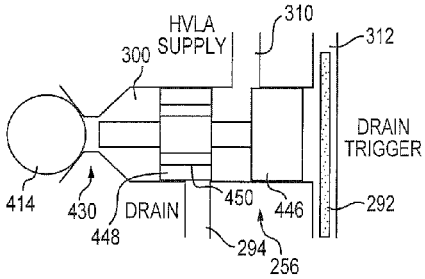
Figure 87:
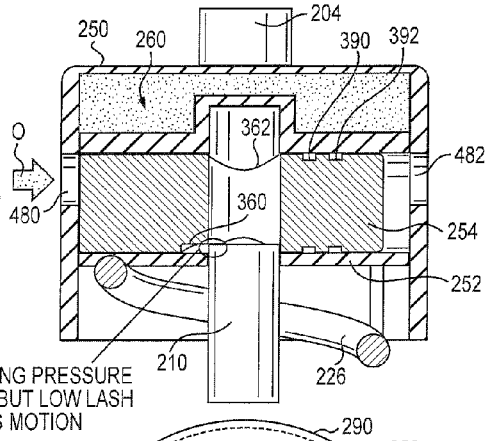
FIGS. 87-90 are similar to FIGS. 83-86 and depict pressurized oil flowing in the first direction through the drain trigger passageway moving the ball valve assembly to the open position, pressurized oil flowing from the lash adjustment chamber through the ball valve assembly and out of the drain of the pin housing (deactive to active, lash adjustment chamber drainage).
Figure 89:
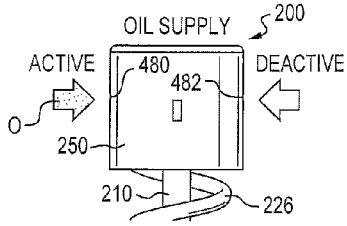
Figure 88:
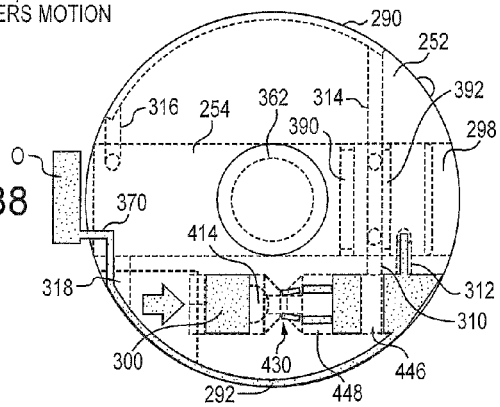
Figure 90:
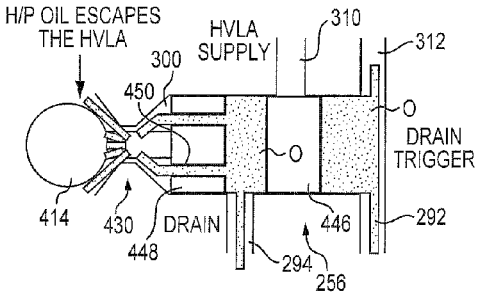
Figure 91:
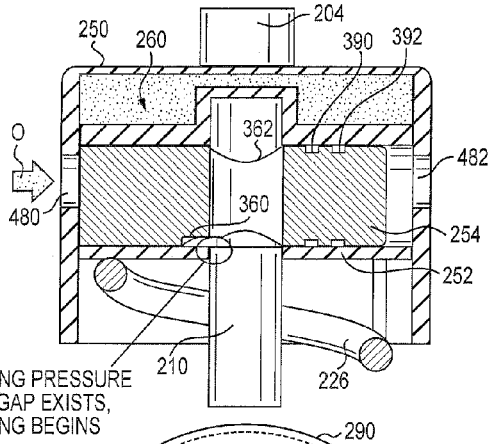
FIGS. 91-94 are similar to FIGS. 87-90 and illustrate pressurized oil flowing out of the lash adjustment chamber, as oil pressure in the lash adjustment chamber decreases the pin housing moves upwardly in the lash adjuster and away from the valve stem thereby creating valve lash (deactive to active, gap exists, switching begins).
Figure 93:
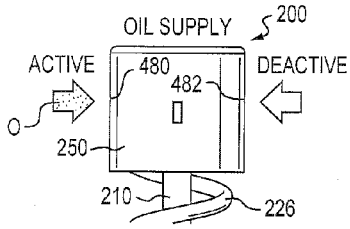
Figure 92:
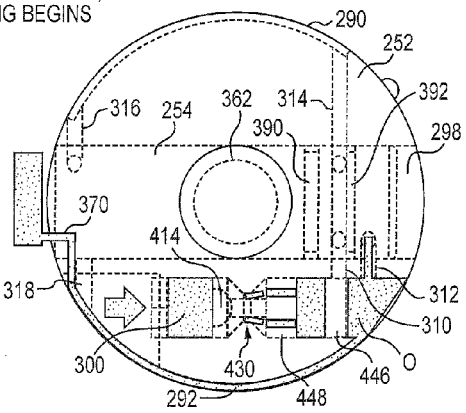
Figure 94:
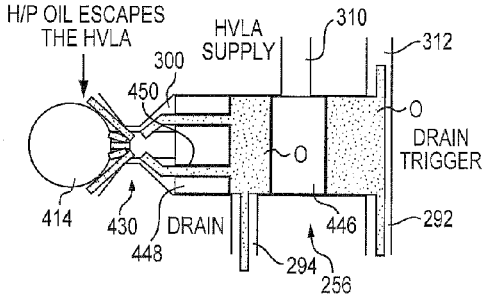
Figure 95:
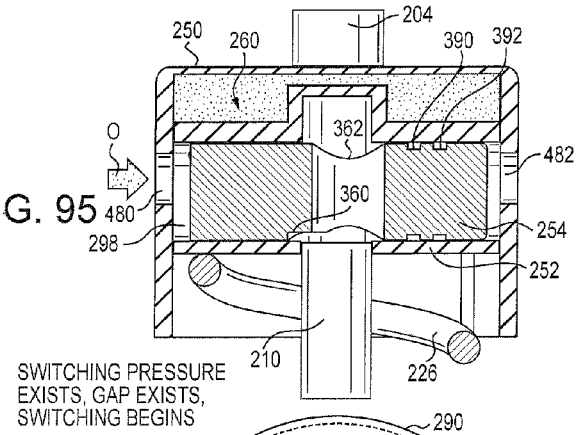
FIGS. 95-98 are similar to FIGS. 91-94 and show the ball valve assembly in the closed position and the sync pin of the valve operating mechanism moving from the deactivating position toward the activating position (switching).
Figure 97:
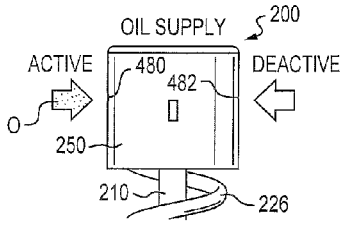
Figure 96:
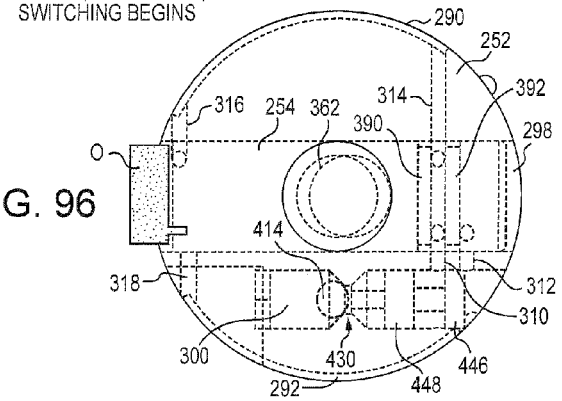
Figure 98:
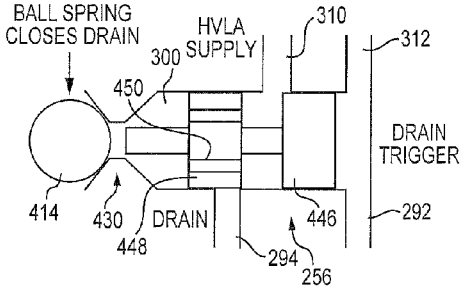
Figure 99:
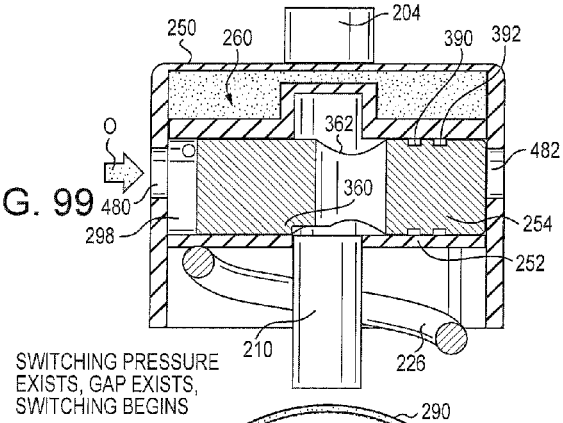
FIGS. 99-102 are similar to FIGS. 95-98 and depict the sync pin in the activating position, pressurized oil flowing through the supply passageway of the pin housing and into the ball valve assembly of the valve operating mechanism (switching complete, HVLA pump begins).
Figure 101:
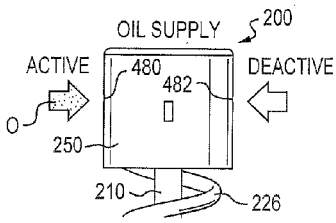
Figure 100:
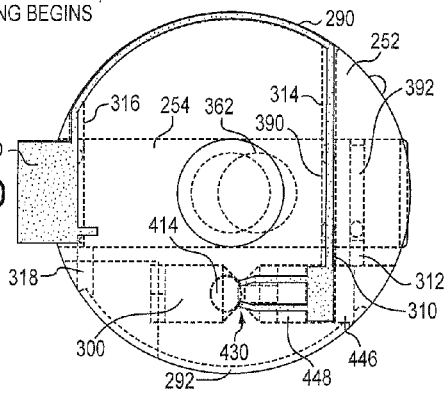
Figure 102:
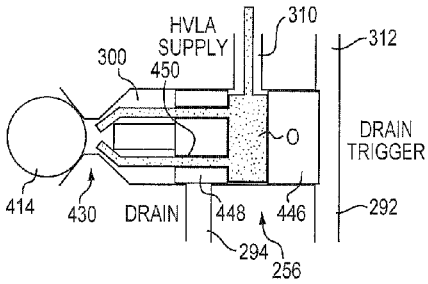
Figure 103:
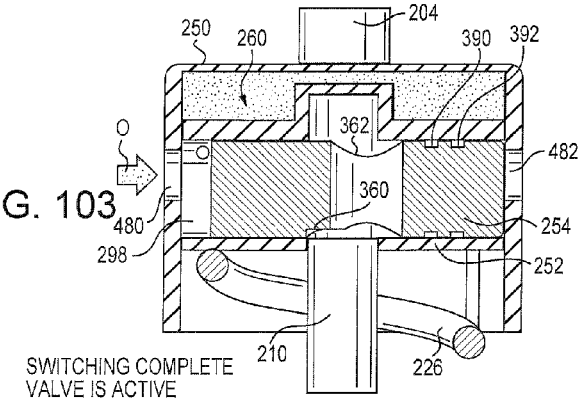
FIGS. 103-106 are similar to FIGS. 99-102 and illustrate pressurized oil flowing through the pin housing and the ball valve assembly, the ball valve assembly being in the open position and pressurized oil flowing in the first direction flowing into the lash adjustment chamber of the valve operating mechanism (active lash adjustment starts again).
Figure 105:
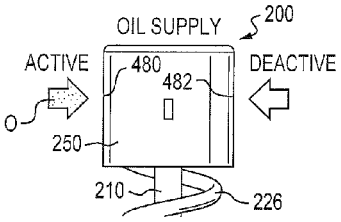
Figure 104:
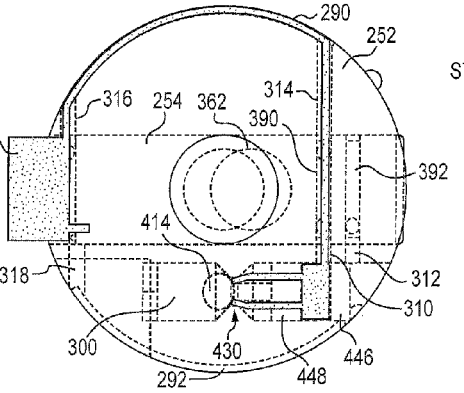
Figure 106:
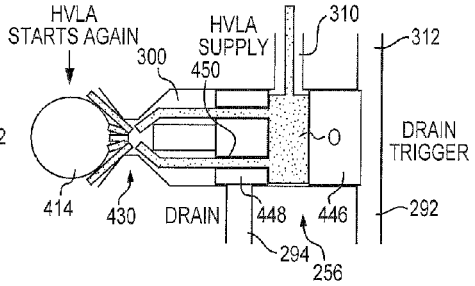

Referring now to the drawings, wherein like numerals refer to like parts throughout the several views, FIGS. 1, 2 and 18 schematically illustrate a valve operating mechanism 200 for an internal combustion engine 202. As is well know, the internal combustion engine 202 includes a camshaft (not shown) having a valve operating cam 204 for engaging a valve stem 210 of one of an intake or exhaust valve 212. The valve 212 is slidably supported in a valve body 214 (i.e., a portion of the engine 202). A retainer 216 is secured to an upper part of the valve stem 210 of the valve 212. A valve spring 220 is set between the retainer 216 and an upper part of a valve guide tube 222. A lifter spring 226 with a larger winding diameter than that of the valve spring 220 is set between the guide tube 222 and the valve operating mechanism 200. The valve 212 is continuously energized by spring force of the valve spring 220 in such a direction (downwardly in the figures) that one of an intake opening or exhaust opening (not shown) of one of an intake port or exhaust port (not shown) is hermetically closed. Further, the valve operating mechanism 200 is continuously energized by spring force of the lifter spring 226 in a direction to abut the operating cam 204. The valve body 214 defines an oil pressure chamber that includes a first port 230 for the flow of pressurized oil in a first direction (depicted in FIGS. 19-106 as reference character "○", and is considered the active oil source) and a second port 232 for the flow of pressurized oil in a second direction (depicted in FIGS. 43-82 as reference character "X", and is considered the deactive oil source). Each port 230,232 is in fluid communication with the valve operating mechanism 200.

The valve operating mechanism 200 includes a lash adjuster 250, a pin housing 252, a sync pin 254 slidably received in the pin housing, and a ball valve assembly 256 (FIG. 2). The pin housing 252 is housed in the lash adjuster 250 and together with the lash adjuster defines a lash adjustment chamber 260. As will be discussed in greater detail below, the valve operating mechanism 200 is operable in one of an active mode and a deactive mode. In the active mode, the sync pin 254 is in an activating position, the valve 212 is in an active state and the valve operating mechanism 200 is configured to adjust valve lash of the valve 212. In the deactive mode, the sync pin 254 is in a deactivating position, the valve 212 is in a deactive state, and the valve operating mechanism 200 is configured to adjust valve lash of the valve 212. The engine 202 is configured to selectively supply pressurized oil to the second port 232 of the oil pressure chamber to move the sync pin 254 from the activating position to the deactivating position, and is configured to selectively supply pressurized oil to the first port 230 of the oil pressure chamber to move the sync pin 254 from the deactivating position to the activating position. The valve operating mechanism 200 is also configured to generate valve lash to allow the valve operating mechanism to move between the active mode and the deactive mode, which, in turn, reduces response time for switching the valve 212 between the active state and the deactive state.

With reference now to FIGS. 3-6, the pin housing 252 includes a generally cylindrical shaped body 270 having a top wall 272, a bottom wall 274 and a side wall 276. The side wall 276 defines the periphery of the pin housing 252 and interconnects the top wall 272 and bottom wall 274. A generally pie-shaped cutout 280 is located on the top wall 272 and side wall 276 and extends partially through the body 270 toward the bottom wall 274. The cutout 280 is in fluid communication with the valve lash chamber 260. A center cylindrical portion 282 projects from the top wall 272 and includes an opening 284 (FIG. 18) which serves as a valve stem guide hole. The pin housing 270 further includes a supply passageway 290, a drain trigger passageway 292 and a drain 294 for the flow of pressurized oil therethrough. Each of the supply passageway 290 and the drain trigger passageway 292 are in fluid communication with the lash adjustment chamber 260 and includes a generally arcuate section extending along the peripheral side wall 276. As shown, the supply passageway 290 can be diametrically spaced and vertically offset from the drain trigger passageway 292. In other words, the supply passage 290 is located on one side of the body 270 opposite the drain trigger passageway 292 and can be positioned closer to the top wall 272 than the drain trigger passageway. In addition, the drain trigger passageway 292 includes a vertically oriented section 296; although, this is not required.

Figure 3:
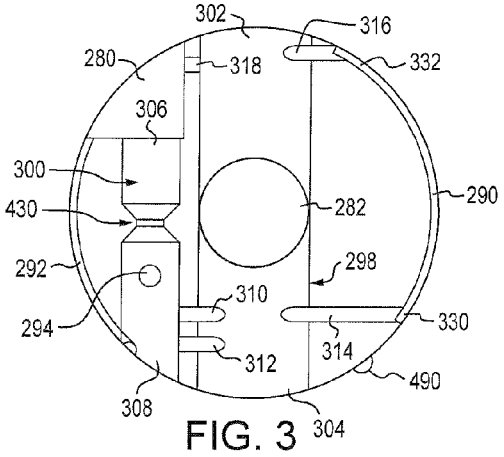
FIG. 3 is a top plan view of a pin housing of the valve operating mechanism of FIG. 1.

In the illustrated embodiment of the pin housing 252, a first bore 298 and a second bore 300 extend through the body 270 in a direction substantially perpendicular to the valve stem 210. More particularly, the first bore 298 extends along a diameter of the body 270 of the pin housing 252 and is centrally located between the top wall 272 and the bottom wall 274. That is, a cylinder center axis of the first bore is substantially collinear with the diameter of the body. Although, it should be appreciated by one skilled in the art the second bore 300 can be canted relative to the first bore 298. The first bore includes a first port 302 and a second port 304. The first port 302 is in fluid communication with the first port 230 of the oil pressure chamber defined by the valve body 214, and the second port 232 in fluid communication with the second port 232 of the oil pressure chamber. Each port 302, 304 is also in fluid communication with the supply passageway 290, which is in fluid communication with the lash adjustment chamber 260. The second bore 300, which can be both laterally and vertically offset from the first bore 298 (i.e., the second bore is located closer to the top wall 272 than the first bore), also includes a first port 306 and a second port 308. The first port 306 in direct communication with the cutout 280 and the lash adjustment chamber 260. The second port 308 of the second bore 300 is in direct fluid communication with the drain trigger passageway 292. As shown in FIG. 3, the drain 294 can extend substantially perpendicularly into the second bore 300 and is in communication with the oil pressure chamber defined by the valve body 214.

The pin housing 252 further includes a plurality of internal fluid passageways for directing pressurized oil through the body 270 of the pin housing. Specifically, and according to one aspect of the present disclosure, the plurality of internal passageways includes a first passageway 310, a second passageway 312, a third passageway 314, a fourth passageway 316 and a fifth passageway 318. Each of the passageways 310-318 can extend substantially perpendicular to a cylinder center axis of each of the first and second bores 298,300; although, this is not required. The first passageway 310 and the second passageway 312 are located immediately adjacent one another near the second port 304 of the first bore 298 and fluidly interconnect the first bore 298 and the second bore 300. In other words, the first and second passageways allow pressurized oil to flow between the first and second bores 298,300. The first passageway 310 is also in selective fluid communication with the supply passageway 290 via the third passageway 314, and the second passageway 312 is in selective fluid communication with the drain trigger passageway 292. The third passageway 314 directs pressurized oil between the first bore 330 and an end portion 330 of the supply passageway 290 that is located closest to the second port 304. As depicted, the third passageway 314 is substantially collinear with the first passageway 310; although, this is not required. The fourth passageway 316 directs pressurized oil between the first bore 298 and the other end portion 332 of the supply passageway 290 located closest to the first port 302. Finally, the fifth passageway 318 allows pressurized oil to flow between the first bore 330 and the lash adjustment chamber 260.

The sync pin 254 is depicted in FIGS. 7-10. The sync pin 254 is slidably received within the first bore 298 of the pin housing 252 between the activating position (FIGS. 19-42) and the deactivating position (FIGS. 67-78), and in the illustrated embodiment the sync pin is slidable in a direction perpendicular to the valve stem 210. The sync pin 254 is cylindrically shaped and has a pin body 350 including a first end face 352 located on a first end portion 354 of the body and a second end face 356 located on a second end portion 358 on the body. Provided on the pin body 350 between the first and second end portions 354 and 358 is a valve stem contact surface 360 for selectively engaging the valve stem 210 and a valve stem through hole 362 adjacent the contact surface for selectively facing the valve stem 210. As shown, the contact surface 360 is cut into the body and is substantially planar (i.e., the contact surface is substantially perpendicular to a center cylinder axis of the through hole 362). The through hole 362 is vertically oriented relative to the contact surface 360 and its center cylinder axis is perpendicular to a pin cylinder center axis. The body 350 of the sync pin 254 further includes a first fluid path 370 provided on the first end portion 354 and a second fluid path 372 provided on the second end portion 358 for the flow of pressurized oil therethrough. The first fluid path 370 includes a port 380 located on the first end face 352 and a port 382 located on a side wall 384 of the body 350. The sync pin 254 further includes a first circumferential groove 390 and a spaced apart second circumferential groove 392 located on the side wall 384 adjacent the second end portion 358 of the body 350. The second fluid path 372 includes a port 400 located on the second end face 356 and a port 402 located in the second groove 392.

Figure 5:
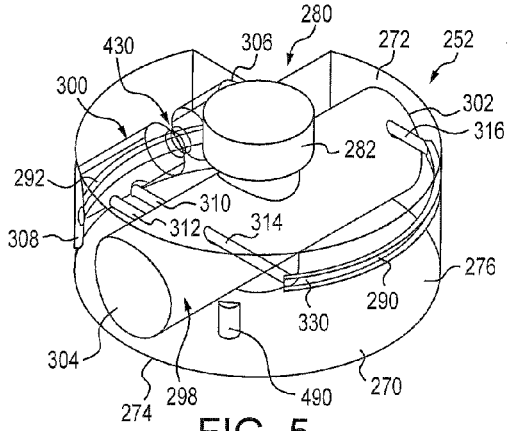
FIG. 5 is a perspective view of the pin housing of FIG. 3.
Figure 4:
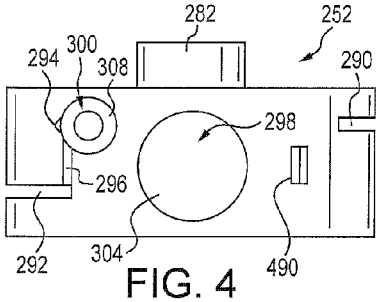
FIG. 4 is a front view of the pin housing of FIG. 3.
Figure 6:
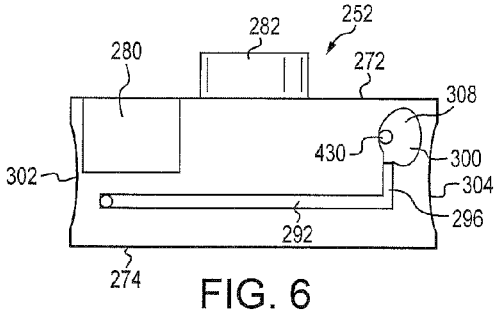
FIG. 6 is a side view of the pin housing of FIG. 3.
Figure 7:
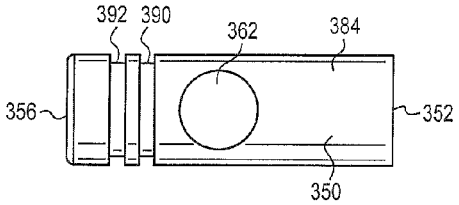
FIG. 7 is a top plan view of a sync pin of the valve operating mechanism of FIG. 1.
Figure 9:
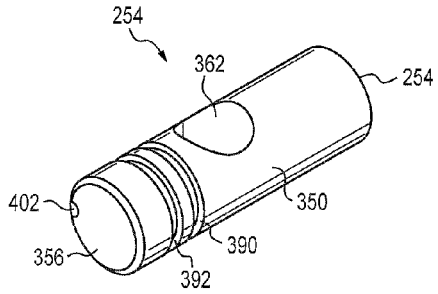
FIG. 9 is a perspective view of the sync pin of FIG. 7.
Figure 8:
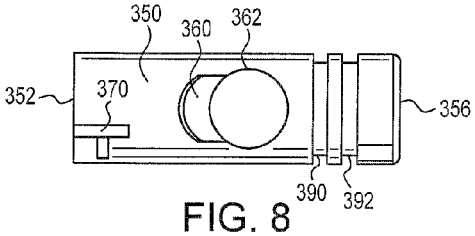
FIG. 8 is a bottom plan view of the sync pin of FIG. 7.
Figure 10:
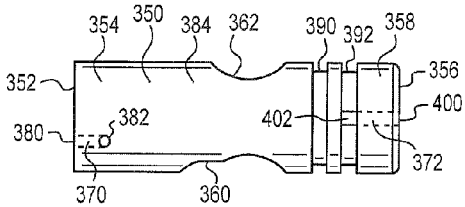
FIG. 10 is a side view of the sync pin of FIG. 7.

As indicated above, the valve operating mechanism 200 comprises the ball valve assembly 256 which is moveable between an open position where the ball valve assembly is in fluid communication with the valve lash adjustment chamber 260 and a closed position. As shown in FIG. 2, the ball valve assembly 256 includes a valve seat 410, a biasing member 412, such as the depicted spring, a ball valve 414 and an oil leak piston or delash pin 416. The ball valve assembly 256 is located in the second bore 300 of the pin housing 252. Particularly, the second bore 300 can include a reduced cross-sectional area 430 (FIGS. 3 and 5). The valve seat 410, biasing member 412 and ball valve 414 are located on one side of the reduced cross-sectional area 430 with the valve seat being positioned adjacent the first port 306 of the second bore 300. The oil leak piston 416 is slidably located on the opposite side of the reduced cross-sectional area 430. The seat 410 is ring-shaped and includes a through hole 432 for the flow of pressurized oil therethrough. The biasing member 412 is positioned between the seat 410 and the ball valve 414 for biasing the ball valve toward the reduced cross-sectional area 430. The oil leak piston 416 is responsive to the flow of pressurized oil and selectively engages the ball valve 414 to move the ball valve assembly 256 to the open position thereby allowing pressurized oil to flow into and out of the lash adjustment chamber 260.

Figure 11:
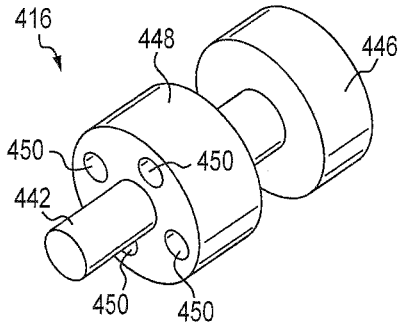
FIG. 11 is a perspective view of a pin of a ball valve assembly of the valve operating mechanism of FIG. 1.
Figure 12:
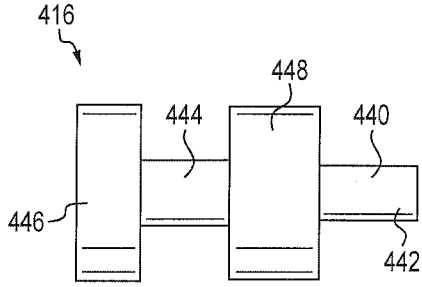
FIG. 12 is a side view of the pin of FIG. 11.
Figure 13:
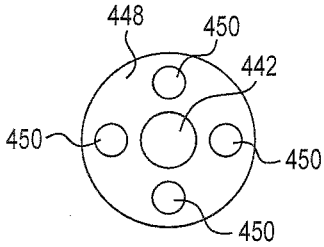
FIG. 13 is a top plan view of the pin of FIG. 11.
Figure 14:
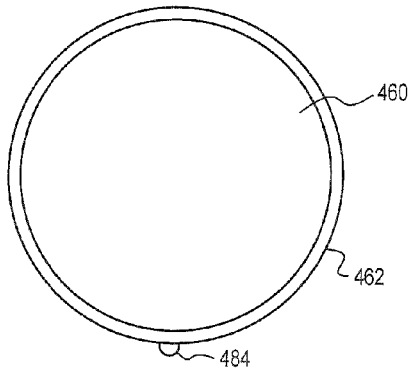
FIG. 14 is a top plan view of a lash adjuster of the valve operating mechanism of FIG. 1.
Figure 16:
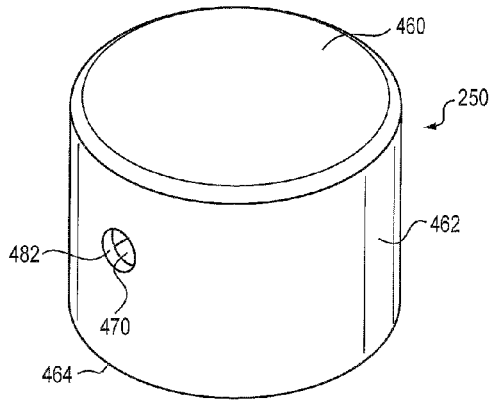
FIG. 16 is a perspective view of the lash adjuster of FIG. 14.
Figure 15:
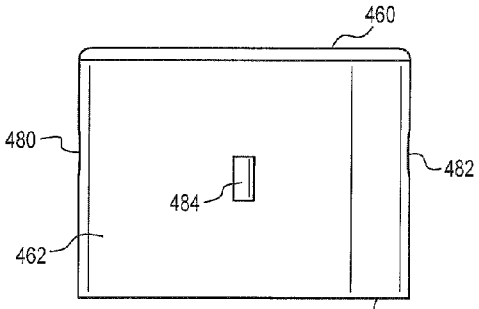
FIG. 15 is a front view of the lash adjuster of FIG. 14.
Figure 17:
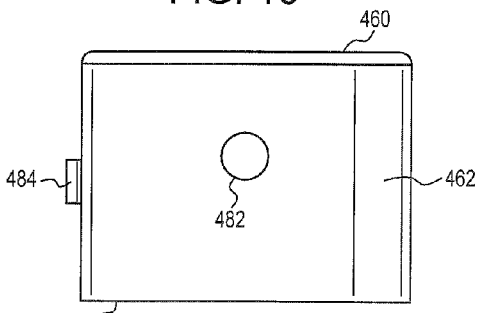
FIG. 17 is a side view of the lash adjuster of FIG. 14.

The oil leak piston 416 is best depicted in FIGS. 11-13. As shown, the oil leak piston 416 includes a cylindrical shaped body 440 having a first end portion 442 and a second end portion 444. The first end portion 442 is adapted to project at least partially through the reduced cross-sectional area 430 and engage the ball valve 414 to move the ball valve assembly to the open position. A first seal member 446 is secured to the second end portion 444 of the body 440, and a second seal member 448 is secured to the body and is spaced from the first seal member. The first seal member 446 can have an axial dimension smaller than an axial dimension of the second seal member 448; although, this is not required. As will be discussed in greater detail below, the first seal member 446 allows selective communication between the first bore 298 and the second bore 300 via one of the first passageway 310 and second passageway 312 of the pin housing 252. The second seal member 448 allows selective communication between the lash adjustment chamber 260 and the drain 294. At least one fluid path or hole 450 extends axially through the second seal member 448 for the passage of pressurized oil to and from the lash adjustment chamber 260. As depicted, four circumferentially spaced through holes 450 are provided on the second seal member 448; although, it should be appreciated that the second seal member can have more or less than four through holes.

With reference now to FIGS. 14-17, the lash adjuster 250 is supported by the valve body 214 and can be positioned between the operating cam 204 and valve stem 210. The lash adjuster has a cup or bucket shape, particularly an inverted cup or bucket shape, and includes a top wall 460, a side wall 462 extending around a periphery of the top wall, and an open bottom 464. The lash adjuster defines a partially enclosed space 470. A first opening 480 and a diametrically opposed second opening 482 are located on the side wall 462. As shown in FIG. 18, the first opening 480 is in fluid communication with the first port 230 of the oil pressure chamber defined by the valve body 214 and the second opening 482 is in fluid communication with the second port 232 of the oil pressure chamber. A projection 484 can also be provided on the side wall 462. The projection engages a portion of the valve body 214 to prevent rotation of the lash adjuster 250 within the valve body. With continued reference to FIG. 18, as indicated above, the lash adjuster 250 together with the pin housing 252 define the lash adjustment chamber 260. The pin housing 252 is displaceable within space 480 of the lash adjuster 250, the displacement depending on the oil pressure within the lash adjustment chamber 260. As will be described below, an increase in oil pressure within the lash adjuster chamber 260 moves the pin housing together with the sync pin 254 toward the valve stem 210 which, in turn, adjusts the valve lash. To allow for such movement and to prevent rotation of the pin housing 252 within the lash adjuster 250, the pin housing includes a key 490 (FIGS. 3-5) that is slidably received in a keyway 492 located on an inner surface of the side wall 462.

The operation of the valve operating mechanism 200 will now be described in more detail. FIGS. 19-42 illustrate the valve operating mechanism 200 in the active mode for adjusting valve lash. In the active mode, oil pressure acts in a first direction on the sync pin 254 causing the sync pin to be in the activating position. Pressurized oil ○ flows through each of the fourth passageway 316, the supply passageway 290, the third passageway 314 and the first passageway 310 of the pin housing 252 to the ball valve assembly 256. The ball valve assembly 256 moves to the open position allowing pressurized oil to flow into the lash adjustment chamber 260. The flow of pressurized oil ○ into the lash adjustment chamber 260 causes engagement between the cam 204 and the lash adjuster 250 which, in turn, moves the contact surface 360 of the pin body 350 into engagement with the valve stem 210 thereby adjusting the valve lash of the valve 212.

Specifically as shown in FIGS. 19-22, in the active mode of the valve operating mechanism 200, pressurized oil ○ flows in the first direction from the first port 230 of the oil pressure chamber into the first opening 480 of the lash adjuster 250. This oil pressure maintains the sync pin 254 in its activating position. In this position, the second end face 352 of the sync pin 254 abuts an inner surface of the lash adjuster 250 adjacent thereby closing the second opening 482. The ball valve assembly 256 is in the closed position, which locates the oil leak piston 416 away from the reduced cross-sectional area 430 of the second bore 300. In this position of the piston 416, the first and second seal members 446, 448 are located on either side of the first passageway 310 such that the first passageway is in fluid communication with the holes 450 extending through the second seal member 448. As shown, the lash adjustment chamber 260 is devoid of pressurized oil and the lash adjuster 250 is spaced from the cam 204.

As shown in FIGS. 23-30, pressurized oil ○ flowing into the pin housing 252 from the first port 230 flows into the first bore 298. Pressurized oil ○ then flows through the fourth passageway 316 into the supply passageway 290 and into the third passageway 314. With the sync pin 254 in the activating position, the first groove 390 provided on the sync pin 254 is aligned with the first and third passageways 310, 314. This allows pressurized oil to flow from the third passageway 314 into the first passageway 310 and into the second bore 300. Pressurized oil ○ then flows through the holes 450 provided on the second seal member 448 of the oil leak piston 416 and into the reduced cross-sectional area 430 of the second bore 300. As shown in FIGS. 31-34, this forces the ball valve 414 of the valve assembly 256 away from the reduced cross-sectional area 430 allowing pressurized oil to flow out of the second bore 300 and into the lash adjustment chamber 260. The last adjustment chamber 260 begins to fill with pressurized oil which starts lash adjustment of the valve 212.

With reference to FIGS. 35-38, as oil pressure in the lash adjustment chamber 260 increases, the lash adjuster 250 moves upwardly into engagement with the cam 204 (this is designated as "PUMP" in the figures.) This engagement of the lash adjuster and cam prevents further movement of the lash adjuster 250. The continued increase in oil pressure in the lash adjustment chamber 260 now causes the pin housing 252 to be displaced downwardly in the lash adjuster 250. The downward displacement of the pin housing 252 moves the valve stem 210 into engagement with the contact surface 360 provided on the sync pin 254. As shown in FIGS. 39-42, with the lash adjustment of the valve 212 now complete, the flow of pressurized oil in the first direction from the first port 230 is reduced. This allows the ball valve 414 of the ball valve assembly 256 to move back against the reduced cross-sectional area 430 of the second bore 300 thereby placing the ball valve assembly 256 in the closed position.

FIGS. 43-78 illustrate the valve operating mechanism 200 moving from the active mode to the deactive mode for deactivating the valve 212 of the engine. To move from the active mode to the deactive mode, oil pressure acts in an opposite second direction on the sync pin 254 in the activating position. Pressurized oil X flowing in the second direction flows through the second fluid path 372 of the sync pin 254 in the activating position and the second passageway 312 of the pin housing 252 to the drain trigger passageway 292 and then to the ball valve assembly 256. This causes the ball valve assembly 256 to move to the open position allowing pressurized oil in the lash adjustment chamber 260 to flow out of the chamber via the drain 294 of the pin housing 252. The contact surface 360 of the pin body 350 moves out of engagement with valve stem 210 allowing the sync pin 254 to move to the deactivating position which aligns the valve stem through hole 362 with the valve stem. Movement of the sync pin 254 to the deactivating position cuts off the flow of pressurized oil from the second fluid path 372 to the drain trigger passageway 292. In the deactive mode, the ball valve assembly 256 is closed and pressurized oil X flowing in the second direction flows through the second fluid path of the sync pin 254, each of the first passageway 310, the third passageway 314, the supply passageway 290, and the fourth passageway 316 of the pin housing 252 and back into the lash adjustment chamber 260. The flow of pressurized oil X into the lash adjustment chamber 260 causes engagement between the cam 204 and the lash adjuster 250 which, in turn, moves the valve stem through hole 362 toward the valve stem 210.

Specifically, FIGS. 43-46 illustrate pressurized oil ○ flowing from the first port still located in the supply passageway 290 and second bore 300. Pressurized oil X now begins to flow from the second port 232 of the oil pressure chamber in the second direction into the lash adjuster 250 via the second opening 482. The flow of pressurized oil X in the second direction provides the switching pressure to move the sync pin 254 from the activating position to the deactivating position. However, engagement between the valve stem 210 and the contact surface 360 of the sync pin 254 hinders motion of the sync pin. With reference to FIGS. 47-54, pressurized oil X flowing in the second direction flows through the second fluid path 372 provided on the sync pin 254 and into the second groove 392 via the port 402. With the sync pin 254 still in the depicted activating position, the second groove 392 is aligned with the second passageway 312 such that the port 402 is in fluid communication with the second bore 300 via the second passageway 312. This allows pressurized oil X flowing in the second direction to flow into the second bore 300 behind the first seal member 446 of the piston 416 of the ball valve assembly 256.

As shown in FIGS. 55-62, pressurized oil X moves the piston 416 into engagement with the ball valve 414 which, in turn, moves the ball valve assembly 256 to the open position. As depicted, the first seal member 446 seals off the first passageway 310 and the drain 294 of the second bore 300 is located between the first seal member 446 and the second seal member 448. Pressurized oil ○ in the lash adjustment chamber 260 now flows into the second bore 300, through the reduced cross-sectional area 430, through the holes 450 provided in the second seal member 448 and out of the drain 294. This reduces oil pressure in the lash adjustment chamber 260 allowing the pin housing 252 to be displaced upwardly in the lash adjuster 250. This upward displacement moves the valve stem 210 away from the contact surface 360 of the sync pin 254, which, in turn, creates valve lash for the valve 212 (see FIGS. 59-62).

As shown in FIGS. 63-66, with the created valve lash, the sync pin 254 is now able to move from the activating position toward the deactivating position via the pressurized oil X flowing in the second direction from the second port 232. Further, with the reduced oil pressure in the lash adjustment chamber 260, the flow of pressurized oil ○ from the lash adjustment chamber into the second bore 300 is reduced thereby allowing the ball valve assembly 254 to move to the closed position. With the sync pin 254 now in the deactivating position, switching is complete and the valve 212 is now deactive (see FIGS. 67-70).

With reference to FIGS. 67-74, the valve stem 210 is aligned with the through hole 362 and the first end face 352 of the sync pin 254 abuts the inner surface of the lash adjuster 250 closing the first opening 480. Pressurized oil X flowing in the second direction from the second port 232 now flows through the second fluid path 372 provided in the sync pin 254 and out of the port 402 located in the second groove 392. In the deactivating position, the second groove 392 is now aligned with the first and third passageways 310, 314 of the pin housing 252. This allows pressurized oil X to flow into the supply passageway 290 via the third passageway 314 and also into the second bore 300 via the first passageway 310. Pressurized oil X flowing through the supply passageway 290 is prevented from flowing into the first bore 298 via the sync pin 254. Pressurized oil X flowing into the second bore 300 flows between the first and second seal members 446, 448 of the piston 416 and through the holes 450 toward the reduced cross-sectional area 430. As illustrated in FIGS. 71-74, the flow of pressurized oil into the second bore 300 moves the ball valve assembly 256 to the open position allowing pressurized oil X to flow through the second bore 300 and into the lash adjustment chamber 260. As oil pressure increases in the lash adjustment chamber 260, the pin housing 252 is displaced downwardly in the lash adjuster 250 (due to the engagement of the lash adjuster 250 with the cam 204). This downward displacement of the pin housing 252 moves the through hole 362 of the sync pin 254 towards the valve stem 210. The switching of the valve 212 from the active state to the deactive state is now complete. As shown in FIGS. 75-78, the flow of pressurized oil X in the second direction from the second port 232 is reduced and the ball valve assembly 256 is moved back to the closed position.

FIGS. 79-106 illustrate the valve operating mechanism 200 moving from the deactive mode back to the active mode. To move from the deactive mode to the active mode, pressurized oil ○ flowing in the first direction flows through the first fluid path 370 of the sync pin 254 in the deactivating position, through the drain trigger passageway 290 to the ball valve assembly 256. The ball valve assembly 256 moves to the open position allowing pressurized oil to flow out of the lash adjustment chamber 260 via the drain 294. This, in turn, moves the sync pin 254 away from the valve stem 210 creating valve lash. The sync pin 254 then moves from the deactivating position toward the activating position. In the activating position of the sync pin, pressurized oil ○ flowing in the first direction is now able to flow through the supply passageway 290 to the ball valve assembly 256. The ball valve assembly moves to the open position allowing the pressurized oil to flow back into the lash adjustment chamber 260.

Specifically, FIGS. 79-82 show pressurized oil ○ again flowing in the first direction from the first port 230 into the lash adjuster 250 via the first opening 480. However, the sync pin 254 is prevented from moving to the activating position due to the location of the valve stem 210 in the through hole 362. Further, the location of the sync pin 254 in the deactivating position prevents the flow of the pressurized oil ○ into the supply passageway 290. With reference to FIGS. 83-86, pressurized oil ○ flowing in the first direction now flows through the first fluid path 370 provided in the sync pin 254 and into the fifth passageway 318. Pressurized oil ○ flowing in the first direction is now directed through the drain trigger passageway 292 and into the second bore 300 behind the first seal member 446 of the piston 416. As depicted in FIGS. 87-94, the flow of pressurized oil ○ through the drain trigger passageway 292 moves the piston 416 toward the ball valve 414, engagement of the piston and the ball valve moves the ball valve away from the reduced cross-sectional area 430. The ball valve assembly 256 is now in the open position and pressurized oil is allowed to flow from the lash adjustment chamber 260 through the second bore 300 and out of the drain 294. This reduces the oil pressure in the lash adjustment chamber 260 allowing the pin housing 252 to be upwardly displaced in the lash adjuster 250. The upward displacement of the pin housing 252 creates valve lash (i.e., moves the sync pin 254 away from the valve stem 210). Pressurized oil ○ flowing in the first direction from the first port 230 now moves the sync pin 254 toward the deactivating position, and the ball valve assembly 254 is moved back to the closed position (see FIGS. 95-98). Finally, as shown in FIGS. 99-106, pressurized oil ○ flowing in the first direction again flows through the supply passageway 290 into the second bore 300 thereby moving the ball valve assembly 254 back to the open position. Pressurized oil ○ flows through the second bore 300 back into the lash adjustment chamber 260. Lash adjustment via the lash operating mechanism 200 begins as described above.

As is evident from the foregoing, a method of operating the valve 212 of the internal combustion engine 202 is provided. The method comprises adjusting valve lash of the valve 212 in a valve active state, the adjusting step including applying oil pressure in a first direction on the sync pin 254 of the valve operating mechanism 200 to move the sync pin 254 to an activating position, and increasing oil pressure in the valve lash adjustment chamber 260 defined by the valve operating mechanism 200 to move the contact surface 360 of the sync pin 254 into engagement with the valve stem 210 of the valve 212; moving the valve 212 to a valve deactive state after valve lash adjustment, the moving step including applying oil pressure in an opposite second direction on the sync pin 254 in the activating position to move the sync pin 254 to a deactivating position, and aligning the through hole 362 provided on the sync pin 254 with the valve stem 210 by increasing oil pressure in the valve lash adjustment chamber 260; and prior to moving the valve 212 between the active state and the deactive state, generating valve lash by decreasing oil pressure in the lash adjustment chamber 260 to allow the sync pin 254 to move from the activating position to the deactivating position.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A valve operating mechanism for an internal combustion engine, the internal combustion engine including a valve operating cam for engaging a valve stem of a valve slidably supported in a valve body, the valve being biased by a spring in a direction to abut the operating cam and having an active state and a deactive state, the valve operating mechanism comprising:

a lash adjuster supported by the valve body;

a pin housing housed in the lash adjuster and together with the lash adjuster defining a lash adjustment chamber, the pin housing including a supply passageway, a drain trigger passageway and a drain for the flow of pressurized oil;

a sync pin slidably received within the pin housing between an activating position and a deactivating position, the sync pin having a pin body including a valve stem contact surface for selectively engaging the valve stem and a valve stem through hole adjacent the contact surface for selectively facing the valve stem, the sync pin body further including a first fluid path and a second fluid path for the flow of pressurized oil; and a ball valve assembly provided within the pin housing, the ball valve assembly moveable between an open position where the ball valve assembly is in fluid communication with the lash adjustment chamber and a closed position, wherein the valve operating mechanism is operable in one of an active mode and a deactive mode, wherein in the active mode the sync pin is in the activating position, the valve is in the active state and the valve operating mechanism is configured to adjust valve lash, wherein in the deactive mode the sync pin is in the deactivating position and the valve is in the deactive state, and wherein the valve operating mechanism is configured to generate valve lash to allow the valve operating mechanism to move between the active mode and the deactive mode.

2. The valve operating mechanism of claim 1, wherein in the active mode, oil pressure acts in a first direction on the sync pin causing the sync pin to be in the activating position, pressurized oil flows through the supply passageway of the pin housing to the ball valve assembly, the ball valve assembly moving to the open position allowing the pressurized oil to flow into the lash adjustment chamber, the flow of pressurized oil into the lash adjustment chamber causing engagement between the cam and the lash adjuster which, in turn, moves the contact surface of the pin body into engagement with the valve stem thereby adjusting the valve lash.

3. The valve operating mechanism of claim 2, wherein to move from the active mode to the deactive mode, oil pressure acts in an opposite second direction on the sync pin in the activating position causing the ball valve assembly to move to the open position allowing the pressurized oil in the lash adjustment chamber to flow out of the chamber via the drain of the pin housing, the contact surface of the pin body moving out of engagement with valve stem allowing the sync pin to move to the deactivating position which aligns the valve stem through hole with the valve stem.

4. The valve operating mechanism of claim 3, wherein pressurized oil flowing in the second direction flows through the second fluid path of the sync pin in the activating position to the drain trigger passageway and then to the ball valve assembly.

5. The valve operating mechanism of claim 4, wherein to move from the deactive mode to the active mode, pressurized oil flowing in the first direction flows through the drain trigger passageway to the ball valve assembly, the ball valve assembly moving to the open position allowing pressurized oil to flow out of the lash adjustment chamber via the drain, which, in turn, moves the sync pin away from the valve stem, the sync pin then moving from the deactivating position toward the activating position, wherein in the activating position of the sync pin the pressurized oil flowing in the first direction is now able to flow through the supply passageway to the ball valve assembly, the ball valve assembly moving to the open position allowing the pressurized oil to flow back into the lash adjustment chamber.

6. The valve operating mechanism of claim 5, wherein pressurized oil flowing in the first direction flows through the first fluid path of the sync pin in the deactivating position to the drain trigger passageway and then to the ball valve assembly.

7. The valve operating mechanism of claim 3, wherein in the deactive mode, the ball valve assembly is closed and pressurized oil flowing in the second direction flows through the supply passageway back into the lash adjustment chamber, the flow of pressurized oil into the lash adjustment chamber causing engagement between the cam and the lash adjuster which, in turn, moves the valve stem through hole toward the valve stem.

8. The valve operating mechanism of claim 7, wherein movement of the sync pin to the deactivating position cuts off the flow of pressurized oil from the second fluid path to the drain trigger passageway, wherein pressurized oil flowing in the second direction now flows through the second fluid path of the sync pin to the supply passageway and then to the lash adjustment chamber.

9. The valve operating mechanism of claim 1, wherein the pin housing further includes a first bore and a second bore, each bore extending through the pin housing in a direction perpendicular to the valve stem and being in fluid communication with the lash adjustment chamber, the sync pin being slidably received in the first bore and the ball valve assembly being operably positioned in the second bore.

10. The valve operating mechanism of claim 9, wherein the ball valve assembly is positioned within the second bore, the ball valve assembly including a valve seat, a biasing member, a ball valve and an oil leak piston, wherein the biasing member is positioned between the seat and the ball valve for biasing the ball valve toward the closed position and the piston selectively engages the ball valve to move the ball valve assembly to the open position.

11. The valve operating mechanism of claim 9, wherein the pin housing further includes a first passageway and a second passageway, the first and second passageways interconnecting the first bore and the second bore, the first passageway being in selective fluid communication with the supply passageway and the second passageway being in selective fluid communication with the drain trigger passageway.

12. The valve operating mechanism of claim 1, wherein the pin housing includes an outer peripheral wall, and each of the supply passageway and the drain trigger passageway includes a section extending along the outer peripheral wall.

13. The valve operating mechanism of claim 1, wherein the sync pin body includes a first end portion and a second end portion, the first fluid path being provided on the first end portion and the second fluid path being provided on the second end portion, and further including a first groove and a spaced apart second groove located on the second end portion, wherein in the activating position the first groove is in selective communication with the supply passageway and in the deactivating position the second groove is in selective communication with the supply passage.

14. The valve operating mechanism of claim 13, wherein a port of the second fluid path of the sync pin body is provided in the second groove.

15. The valve operating mechanism of claim 1, wherein the pin housing is displaceable within the lash adjuster, wherein an increase in oil pressure within the lash adjuster chamber moves the pin housing together with the sync pin toward the valve stem which, in turn, adjusts the valve lash.

16. A valve operating mechanism for an internal combustion engine, the internal combustion engine including a valve operating cam for engaging a valve stem of a valve slidably supported in a valve body, the valve being biased by a spring in a direction to abut the operating cam and having an active state and a deactive state, the valve operating mechanism comprising:

a lash adjuster supported by the valve body;

a pin housing housed in the lash adjuster and together with the lash adjuster defining a lash adjustment chamber, the pin housing including a supply passageway, a drain trigger passageway and a drain for the flow of pressurized oil, the supply passageway and drain being in fluid communication with the lash adjustment chamber, the pin housing further including a first bore and a second bore extending therethrough;

a sync pin slidably received within the first bore of the pin housing between an activating position and a deactivating position, the sync pin including a valve stem contact surface for selectively engaging the valve stem and a valve stem through hole adjacent the contact surface for selectively facing the valve stem, the sync pin further including a first fluid path and a second fluid path for the flow of pressurized oil; and a ball valve assembly provided within the second bore of the pin housing, the ball valve assembly moveable between an open position where the ball valve assembly is in fluid communication with the lash adjustment chamber and a closed position, wherein the valve operating mechanism is operable in one of an active mode and a deactive mode, wherein in the active mode the valve is in the active state and in the deactive mode the valve is in the deactive state, wherein in the active mode, oil pressure acts in a first direction on the sync pin causing the sync pin to be in the activating position, pressurized oil flows through the supply passageway of the pin housing into the lash adjustment chamber, an increase in oil pressure in the lash adjustment chamber moving the contact surface of the sync pin into engagement with the valve stem thereby adjusting the valve lash, wherein in the deactive mode, oil pressure acts in an opposite second direction on the sync pin in the activating position causing the sync pin to move to the deactivating position, in the deactivating position the through hole provided on the sync pin being aligned with the valve stem, and wherein prior to moving between the active mode and the deactive mode, the valve operating mechanism is configured to generate valve lash to allow the sync pin to move between the activating position and the deactivating position.

17. The valve operating mechanism of claim 16, wherein in the active mode, an increase in oil pressure in the lash adjustment chamber causing engagement between the cam and the lash adjuster which, in turn, moves the pin housing together with the sync pin toward the valve stem.

18. The valve operating mechanism of claim 16, wherein to move from the active mode to the deactive mode, pressurized oil flowing in the opposite second direction flows through the second fluid path of the sync pin in the activating position to the drain trigger passageway, the pressurized oil in the drain trigger passageway causing the ball valve assembly to move to the open position allowing pressurized oil in the lash adjustment chamber to flow out of the chamber via the drain of the pin housing, the reduction in oil pressure in the lash adjustment chamber generating valve lash which allows the sync pin to move to the deactivating position.

19. The valve operating mechanism of claim 16, wherein in the deactive mode, the ball valve assembly is closed and pressurized oil flowing in the second direction flows through the second fluid path of the sync pin in the deactivating position and through the supply passageway back into the lash adjustment chamber, the flow of pressurized oil into the lash adjustment chamber increasing the oil pressure in the lash adjustment chamber causing engagement between the cam and the lash adjuster which, in turn, moves the valve stem through hole of the sync pin toward the valve stem.

20. The valve operating mechanism of claim 16, wherein to move from the deactive mode to the active mode, pressurized oil flowing in the first direction flows through the first fluid path of the sync pin in the deactivating position and through the drain trigger passageway to the ball valve assembly, the pressurized oil in the drain trigger passageway causing the ball valve assembly moving to the open position allowing pressurized oil to flow out of the lash adjustment chamber via the drain, the reduction in oil pressure in the lash adjustment chamber generating valve lash which allows the sync pin to move to the activating position, wherein in the activating position of the sync pin the pressurized oil flowing in the first direction is now able to flow through the supply passageway to the ball valve assembly, the ball valve assembly moving to the open position allowing the pressurized oil to flow back into the lash adjustment chamber.

21. A valve operating mechanism for an internal combustion engine, comprising:

a valve for selectively opening and closing a port associated with a cylinder of the engine, the valve operable in one of an active and a deactive state;

a spring biasing the valve toward a closed position;

a valve operating cam for engaging a valve stem of the valve to selectively move the valve toward an open position against the biasing of the spring; and a valve lash adjuster having a sync pin for adjusting a valve lash of the valve, the sync pin is moved to an activating position when the valve is in the active state wherein the sync pin inhibits lifting of the valve stem of the valve to adjust the valve lash of the valve and is moved to a deactivating position when the valve in is in the deactive state wherein the sync pin allows complete lifting of the valve stem, wherein prior to moving between the active state and the deactive state, the valve operating mechanism is configured to generate valve lash to allow the sync pin to move between the activating position and the deactivating position.

22. A method of operating a valve of an internal combustion engine comprising:

adjusting valve lash of the valve in a valve active state, the adjusting step including applying oil pressure in a first direction on a sync pin of a valve operating mechanism to move the sync pin to an activating position, and increasing oil pressure in a valve lash adjustment chamber defined by the valve operating mechanism to move a contact surface of the sync pin into engagement with a valve stem of the valve;

moving the valve to a valve deactive state after valve lash adjustment, the moving step including applying oil pressure in an opposite second direction on the sync pin in the activating position to move the sync pin to a deactivating position, and aligning a through hole provided on the sync pin with the valve stem by increasing oil pressure in the valve lash adjustment chamber; and prior to moving the valve between the active state and the deactive state, generating valve lash by decreasing oil pressure in the lash adjustment chamber to allow the sync pin to move from the activating position to the deactivating position.

* * * * *